US007805969B2

(12) United States Patent
Poppe et al.

(10) Patent No.: US 7,805,969 B2
(45) Date of Patent: Oct. 5, 2010

(54) MASTER KEYED COMBINATION LOCK

(75) Inventors: Carl H. Poppe, Sebastopol, CA (US); George T. Yu, Petaluma, CA (US)

(73) Assignee: ACCO Brands USA LLC, Lincolnshire, IL (US)

( * ) Notice: Subject to any disclaimer, the term of this patent is extended or adjusted under 35 U.S.C. 154(b) by 508 days.

(21) Appl. No.: 11/821,463

(22) Filed: Jun. 22, 2007

(65) Prior Publication Data

US 2008/0006066 A1 Jan. 10, 2008

Related U.S. Application Data

(60) Provisional application No. 60/816,232, filed on Jun. 23, 2006.

(51) Int. Cl.
*E05B 41/00* (2006.01)

(52) U.S. Cl. ..... 70/432; 70/58; 70/312; 70/435

(58) Field of Classification Search ..... 70/58, 70/312, 315–318, 331, 432, 446, 435, 441, 70/465

See application file for complete search history.

(56) References Cited

U.S. PATENT DOCUMENTS

| | | | | |
|---|---|---|---|---|
| 4,803,860 | A | 2/1989 | Moore | |
| 4,901,057 | A * | 2/1990 | Suneborn | 340/542 |
| 4,908,605 | A | 3/1990 | Takasuka | |
| 5,622,067 | A | 4/1997 | Waitz | |
| 6,058,744 | A * | 5/2000 | Ling | 70/28 |
| 6,255,957 | B1 | 7/2001 | Sonderegger et al. | |
| 6,420,958 | B1 * | 7/2002 | Miller et al. | 340/5.55 |
| 6,523,373 | B1 * | 2/2003 | Su | 70/58 |
| 6,672,117 | B2 | 1/2004 | Yu | |
| 6,799,445 | B1 | 10/2004 | Tsai | |
| 6,911,897 | B2 * | 6/2005 | Miller et al. | 340/5.55 |
| 6,973,809 | B2 * | 12/2005 | Chang | 70/58 |
| 7,140,210 | B2 * | 11/2006 | Cheng | 70/58 |
| 7,370,499 | B1 * | 5/2008 | Lee | 70/58 |
| 7,540,334 | B2 * | 6/2009 | Gass et al. | 173/2 |
| 2005/0280500 | A1 * | 12/2005 | Miller et al. | 340/5.55 |
| 2009/0090149 | A1 * | 4/2009 | Fox | 70/311 |

FOREIGN PATENT DOCUMENTS

| | | |
|---|---|---|
| DE | 10203647 | 8/2003 |
| GB | 2201725 A | 9/1988 |

* cited by examiner

*Primary Examiner*—Suzanne D Barrett
(74) *Attorney, Agent, or Firm*—Townsend and Townsend and Crew LLP

(57) ABSTRACT

A multiple dial lock includes reset dials rotatable around a lock shaft. Each reset dial must be at a specific angular position for a user to unlock the lock or reset the combination. Each reset dial has a magnet. A master key includes sensors, each in communication with one signal. Each of the signals indicates to a user that a respective magnet is adjacent a respective sensor, thus assisting a user in recovering a lost combination. A rotary lock includes a dial which rotates a drive cam, which in turn rotates several wheels to their unlocking positions. One magnet for each wheel is provided on the drive cam. Each magnet communicates with one sensor provided on a master key, which also includes signals, indicating that a respective magnet is adjacent a respective sensor, thus assisting a user in recovering a lost combination.

34 Claims, 30 Drawing Sheets

MASTER KEYED COMBINATION LOCK

CROSS-REFERENCE TO RELATED APPLICATION

This application claims priority to and the benefit of U.S. Provisional Application No. 60/816,232, filed on Jun. 23, 2006, the entire contents of which are incorporated herein by reference.

BACKGROUND OF THE INVENTION (a) Field of the Invention

The present invention relates to combination locks, and more particularly to a combination lock that is provided with a master key, which can be used to recover a lost combination.

(b) Description of the Related Art

Generally, a resettable multiple dial combination lock has reset dials connected to the interior surfaces of outer dials. To reset the combination of such a lock, the outer dials are turned to the correct combination, and a reset button is then pressed. The reset dials move along with the reset button, disengaging from the outer dials, which allows the outer dials to freewheel. Upon the reset button's release, the reset dials slide into and engage with the outer dials once more, resetting the combination to that shown by the new positions of the outer dials. However, once a combination to such a lock is lost or forgotten, it can be extremely difficult to recover.

A rotary lock includes a single dial, which rotates a spindle that passes through clearance holes in the centers of wheels (one wheel for each number in the combination), and turns a drive cam located behind the wheels. A drive pin protruding from the front surface of the drive cam engages a wheel fly on the back surface of the backmost wheel. Each wheel has one wheel fly on its back surface and one on its front, such that each wheel is rotated by the wheel directly behind it. In dialing the first number in the combination, a user rotates the dial several complete rotations clockwise, such that all the wheel flies are engaged with one another, and thus all the wheels are rotating, until the frontmost wheel is at its unlocking position. At its unlocking position, a notch in the wheel is directly below a fence. This is repeated counterclockwise for the second wheel, and so on until all wheels are at their unlocking positions, at which point the fence falls into the notches, unlocking the lock.

Other combination locks have been provided with a master key feature. While such a feature may permit opening of the lock without the combination, it does not facilitate recovery of a lost combination.

SUMMARY OF THE INVENTION

According to a first exemplary embodiment of the present invention, a resettable multiple dial lock comprises a lock shaft, reset dials, outer dials, and reset member which resets a combination of the outer dials. The reset dials are rotatably and slidably connected to the lock shaft, and each includes a magnet. The outer dials are each selectively attached to one of the reset dials. The reset member detaches the reset dials from the outer dials.

The reset member may comprise a reset button which slides the reset dials forward while the outer dials remain in their original positions, and a bias spring that urges the reset dials back to their starting positions such that they re-engage with the outer dials.

The reset dials may each further comprise a locking tab which must be in a specific angular location for the lock to be unlocked or reset. Each magnet is at a predetermined angular position relative to the locking tab. The angular position may be selected from a plurality of possible positions, allowing for several master combinations. The angular distance between possible magnet positions may be identical to the angular distance between numerals on the outer dials.

A master key according to an exemplary embodiment of the present invention may comprise sensors such as Hall effect sensors or Reed sensors and signals such as LEDs. Each of the signals informs a user when a magnet of a corresponding reset dial is adjacent its respective sensor. When all signals have signaled the user, the user applies the master combination by rotating the outer dials. The resultant positions of the outer dials define the lost combination.

In a further exemplary embodiment, a multiple dial lock is not resettable. In such an embodiment, separate outer dials are not used; the reset dials themselves define the combination.

In a second exemplary embodiment, a rotary combination lock includes a dial which rotates a drive cam located behind a plurality of wheels. To rotate the first wheel to its unlocking position, a user rotates the dial several full rotations clockwise, and then keeps rotating the dial to the first number in the combination. The drive cam rotates the rearmost wheel, which rotates the wheel directly in front of it, and so on. The dial is turned clockwise for the first wheel, counterclockwise for the second, and so on, until all wheels are in their unlocking positions.

One magnet for each wheel, that is, for each number in the combination, is provided on the drive cam. Each magnet communicates with one sensor provided on a master key, which also includes signals as described above. Each signal indicates the angular position of the corresponding wheel, allowing the user to apply the master combination by further rotating the dial until the wheel is in its unlocking position and the correct number is shown on the face of the dial.

DETAILED DESCRIPTION OF THE PREFERRED EMBODIMENTS

Figure 1:
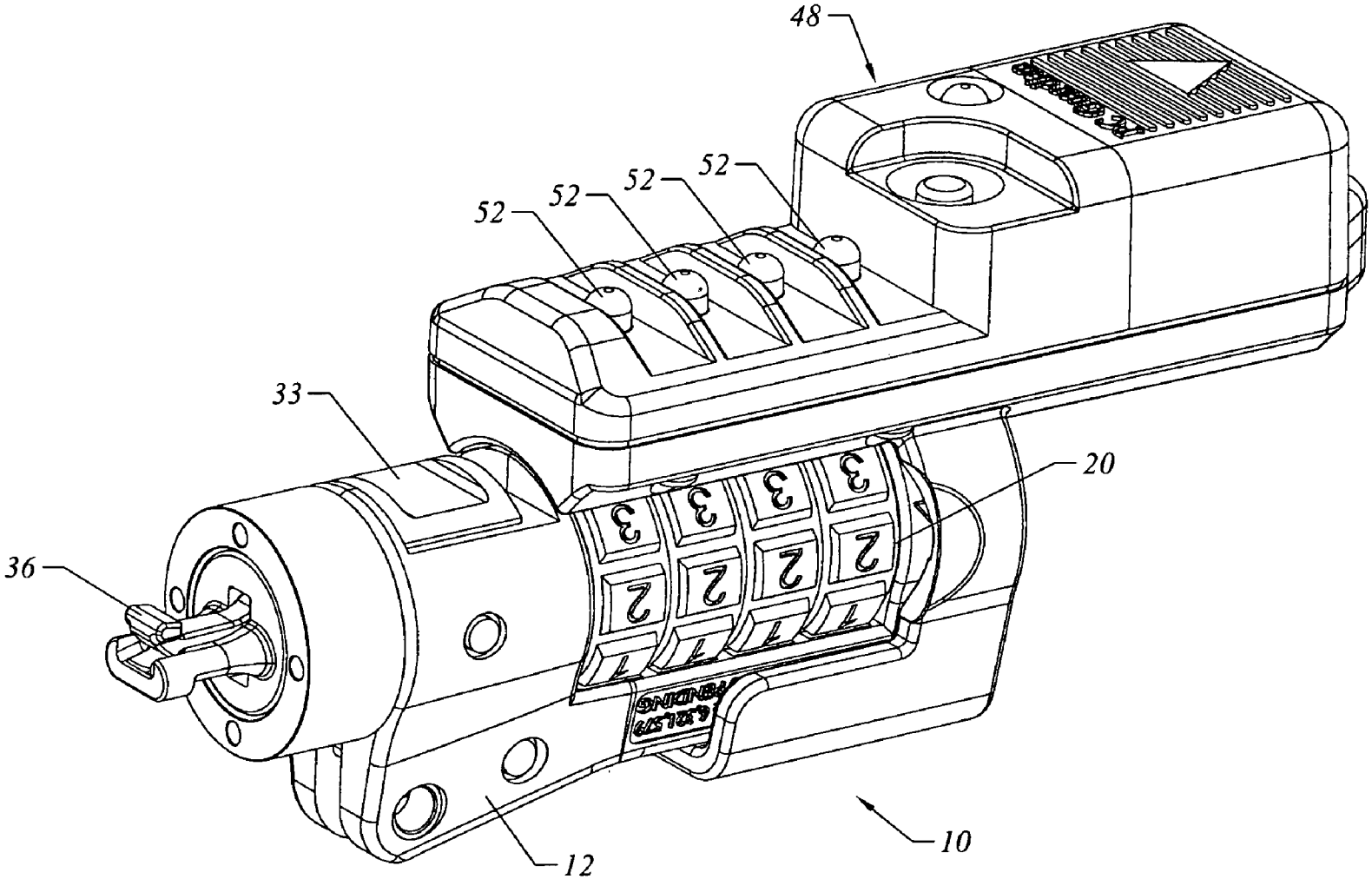
FIG. 1 is a perspective view of a master keyed combination lock and a master key according to an embodiment of the present invention.

Exemplary embodiments of the present invention will hereinafter be described in detail with reference to the accompanying drawings.

In some embodiments, lock 10 is a resettable multiple dial combination lock. This embodiment provides a lock control member such as lock shaft 18, plural combination members such as reset dials 16, a locking member such as locking arm 36, first indicator elements such as magnets 46, second indicator elements such as sensors 50, a reset member such as reset button 34, and dial locking members such as locking tabs 28 disposed on reset dials 16.

Figure 2:
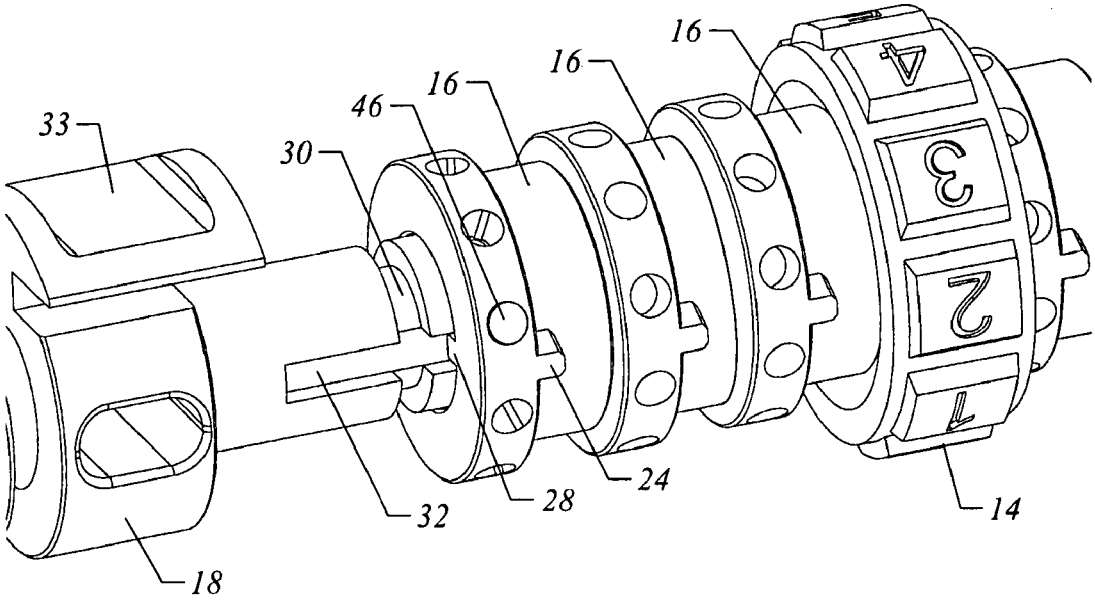
FIG. 2 is a perspective view of the lock of FIG. 1 with the lock housing and several of the outer dials removed, and the reset dials moved back for clarity.
Figure 3:
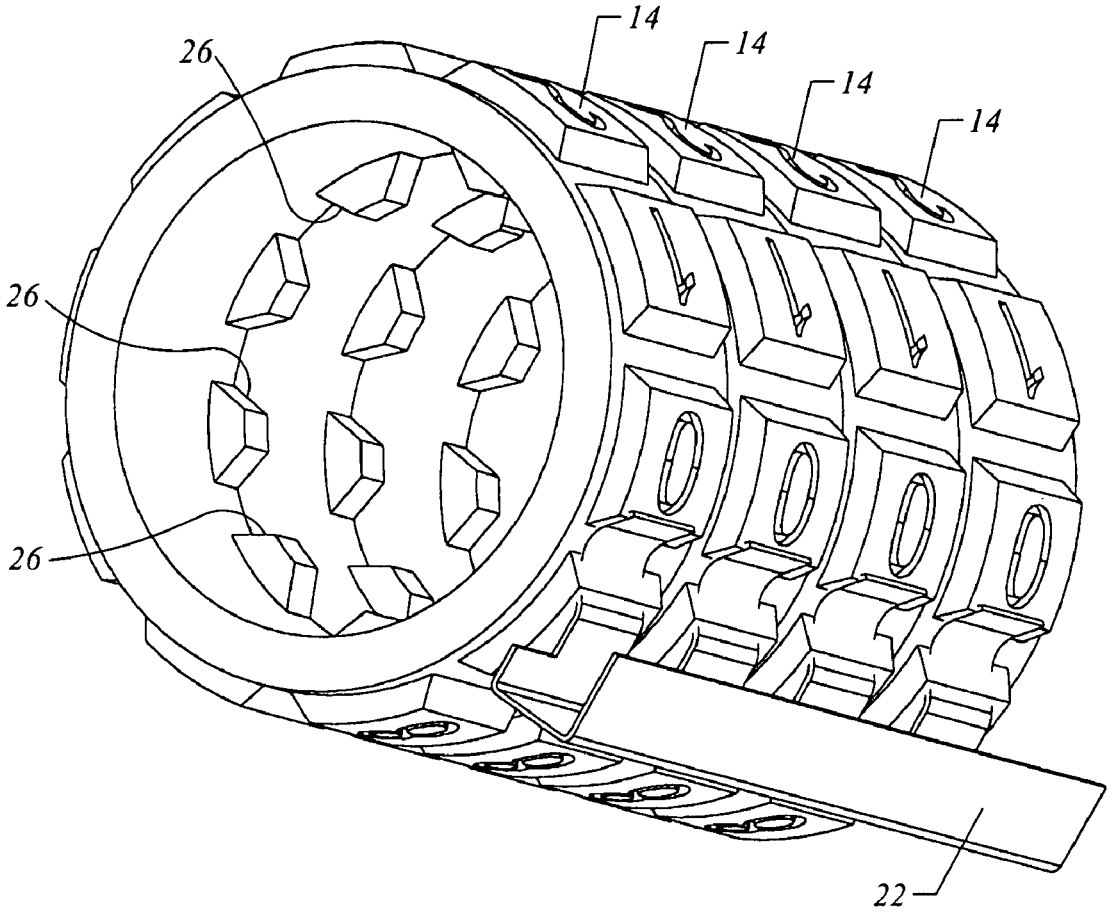
FIG. 3 is a perspective view of outer dials and a guide of the lock of FIG. 1.

Basic components of lock 10 are housing 12, which retains outer dials 14, reset dials 16, and lock shaft 18. Referring to FIGS. 1-3, outer dials 14 are positioned in part in viewing area 20 to be rotated by a user such that they define a sequence of numerals as seen in FIG. 1. Guide 22, positioned within the housing 12 as shown in FIG. 3, acts on the outer dials 14 to ensure that each outer dial 14 is rotated to a numeral position and not to an intermediate angular position.

Figure 4:
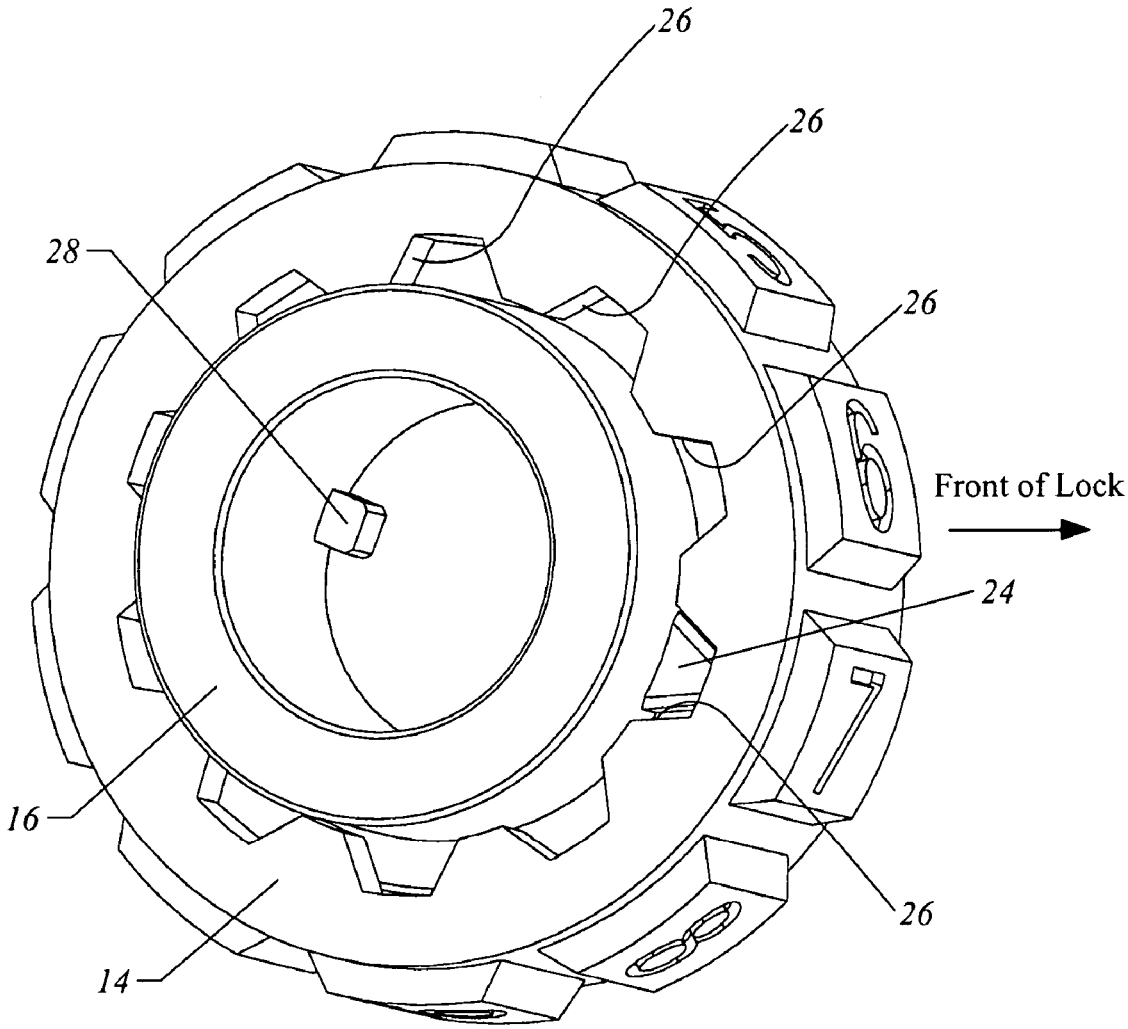
FIG. 4 is a rear perspective view of an outer dial and a reset dial of the lock of FIG. 1.
Figure 5:
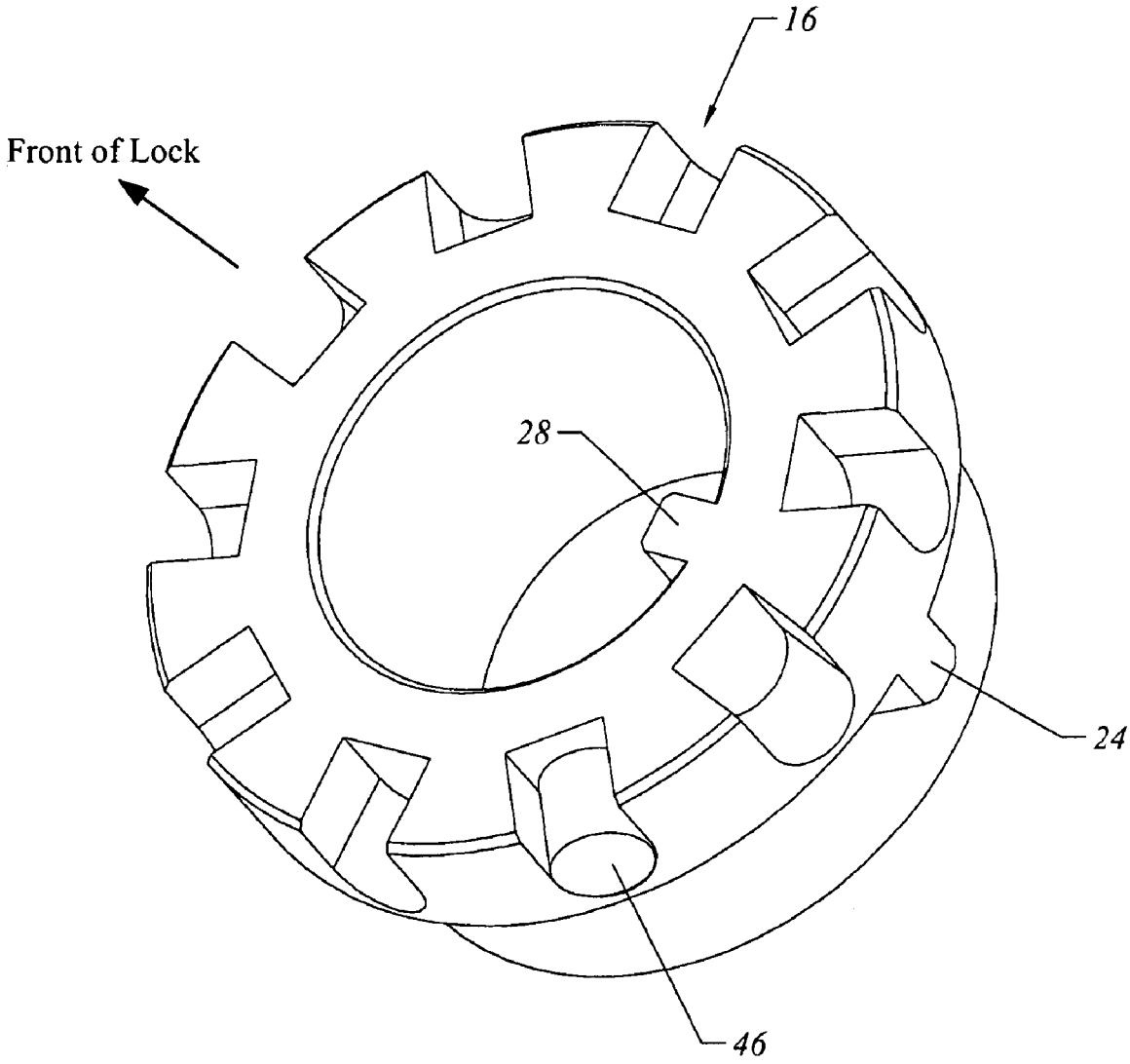
FIG. 5 is a front perspective view of the reset dial of FIG. 4.

Referring to FIGS. 4 and 5, a reset dial 16 is selectively rotatable along with each outer dial 14 by means of one or more reset dial keys 24. The reset dial keys 24 are positioned on reset dial 16 to be received within a notch 26 in the interior surface of outer dial 14. Outer dial 14 may comprise one notch 26 per numeral. When lock 10 is in the locked position, which will be described below, reset dial key 24 is situated within a notch 26 of outer dial 14 and reset dial 16 rotates along with outer dial 14.

Figure 6:
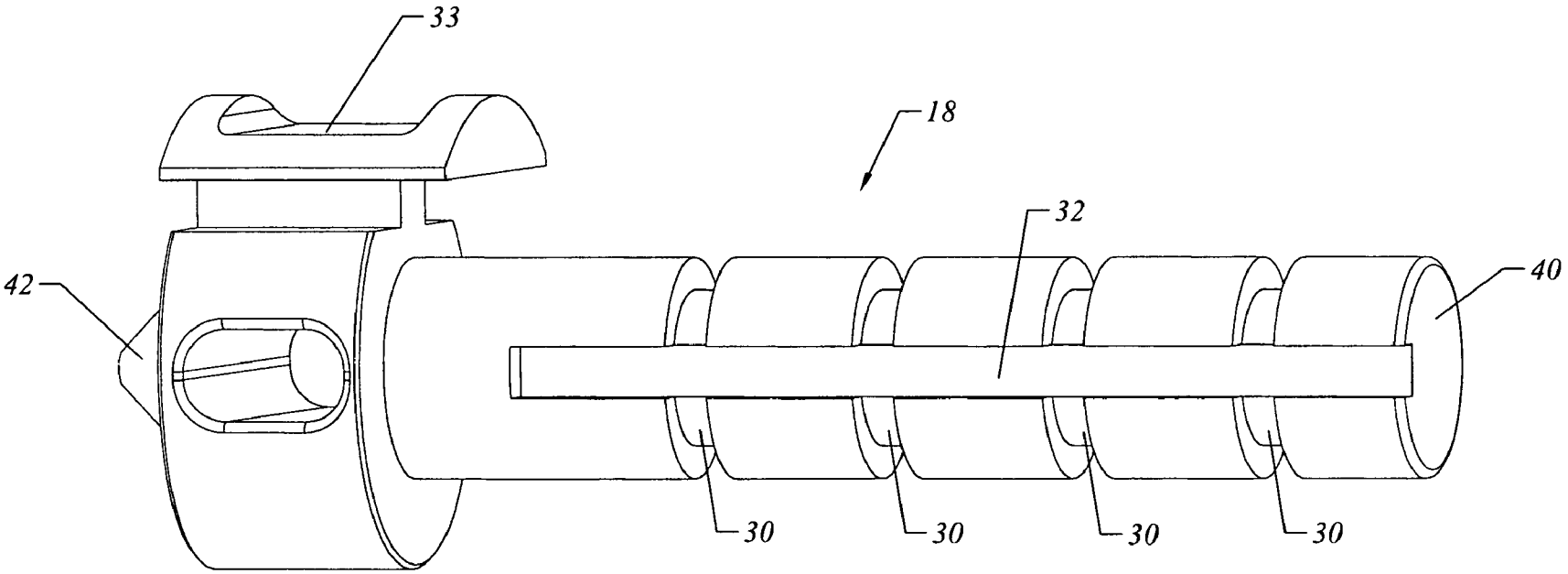
FIG. 6 is a perspective view of a lock shaft of the lock of FIG. 1.
Figure 7A:
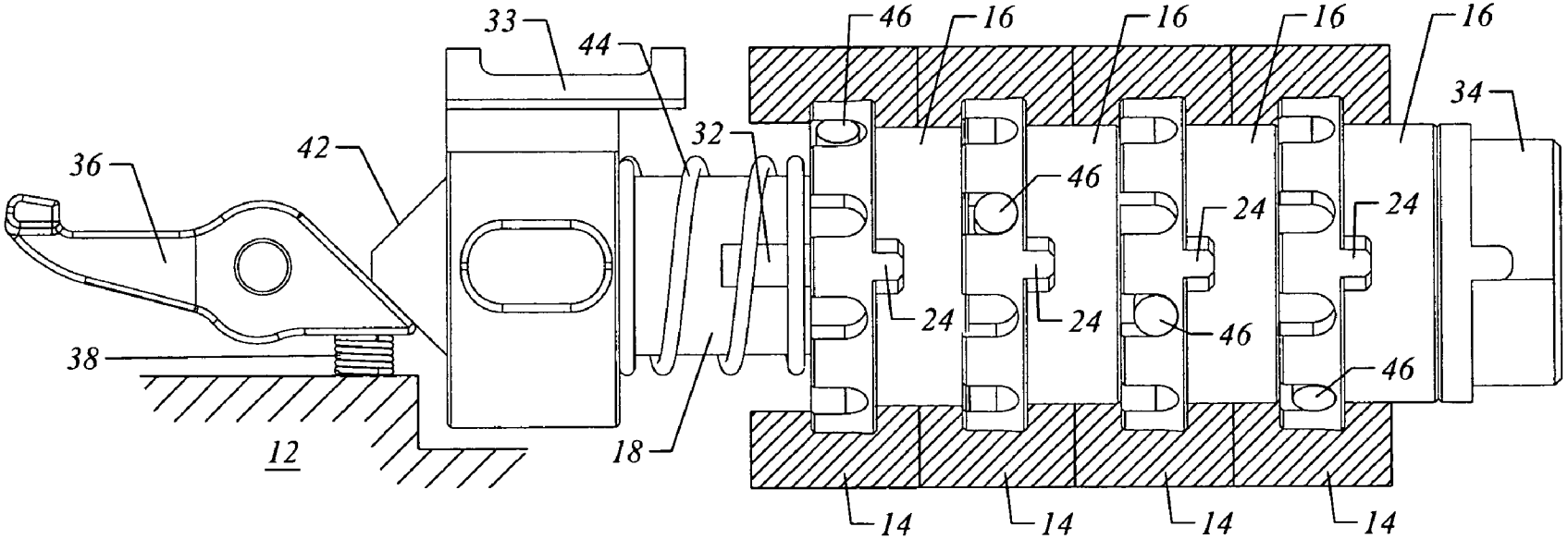
FIG. 7A is a side view of a lock shaft, locking mechanism, bias spring, reset button, reset dials, and outer dials (shown in a sectional view) of the lock of FIG. 1, in the locked position, with a portion of the housing schematically represented.
Figure 7B:
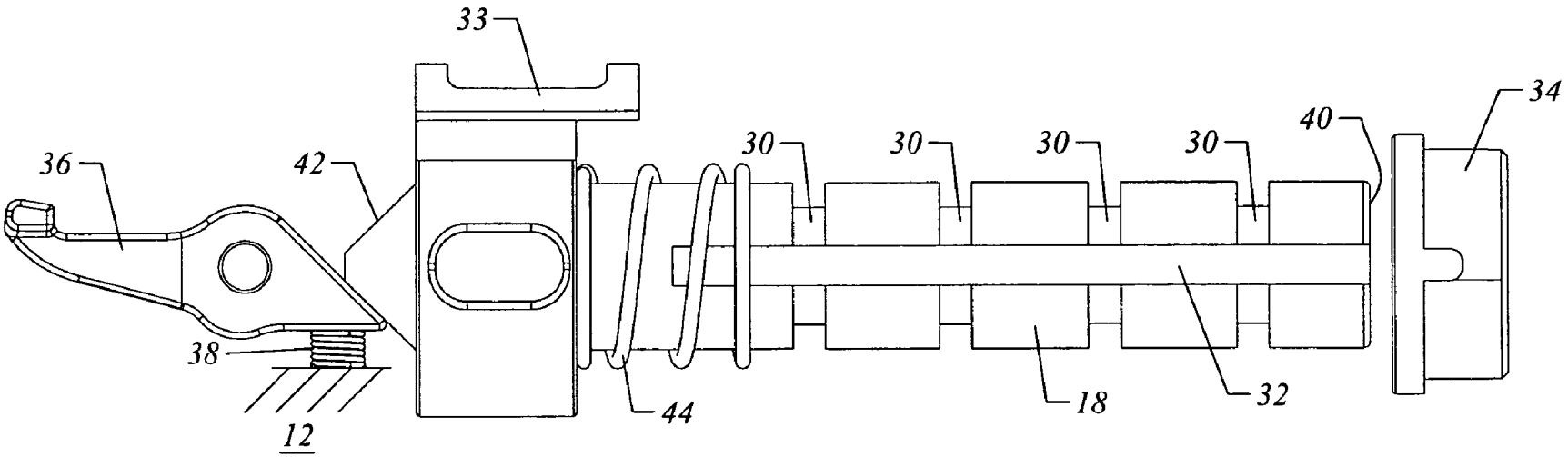
FIG. 7B is a view similar to FIG. 7A with the reset dials and outer dials removed.
Figure 8A:
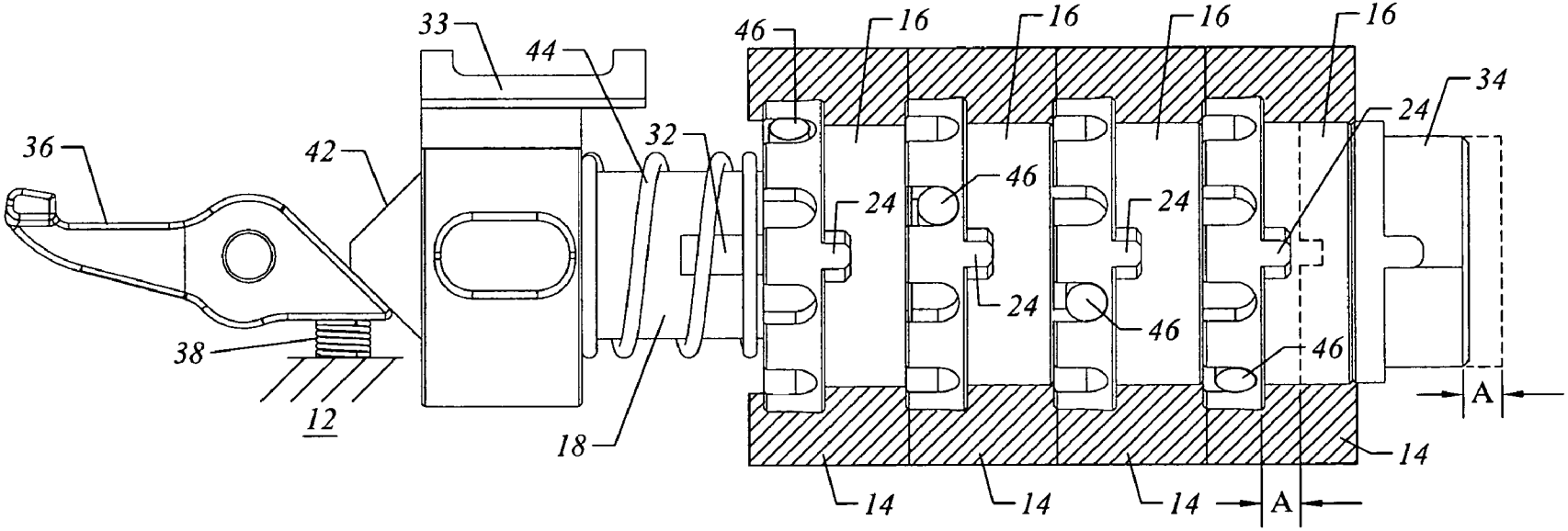
FIG. 8A is a view similar to FIG. 7A with the lock in the reset position, with movement of the reset button and reset dials relative to their positions in FIG. 7A shown in dotted lines.
Figure 8B:
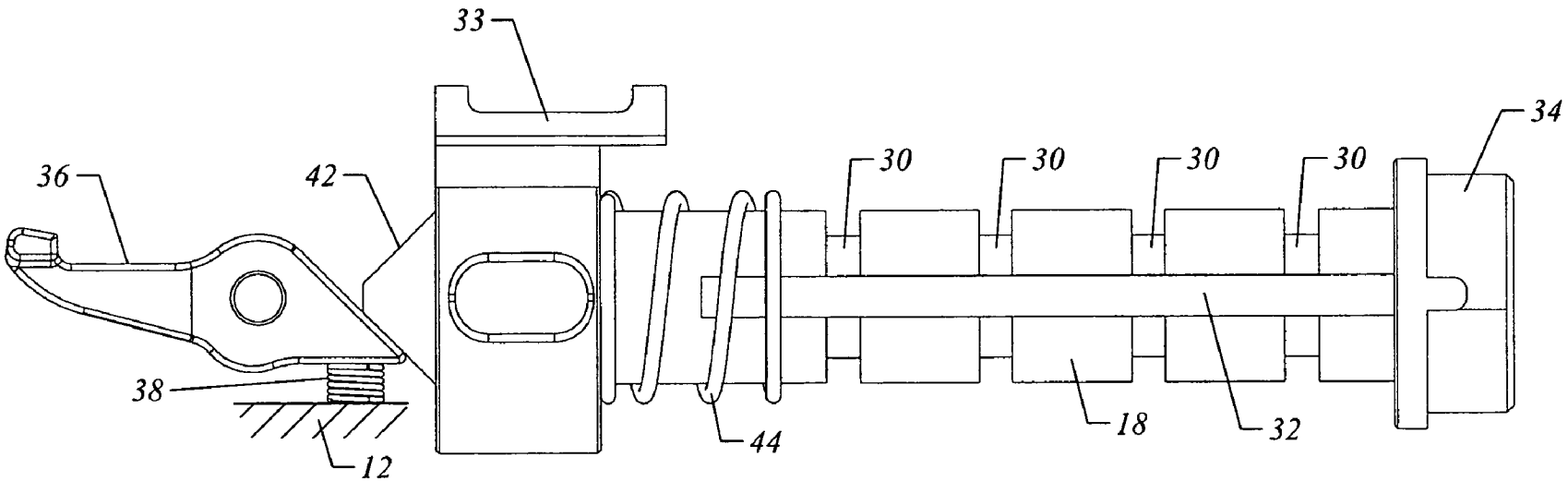
FIG. 8B is a view similar to FIG. 7B with the lock in the reset position.
Figure 9A:
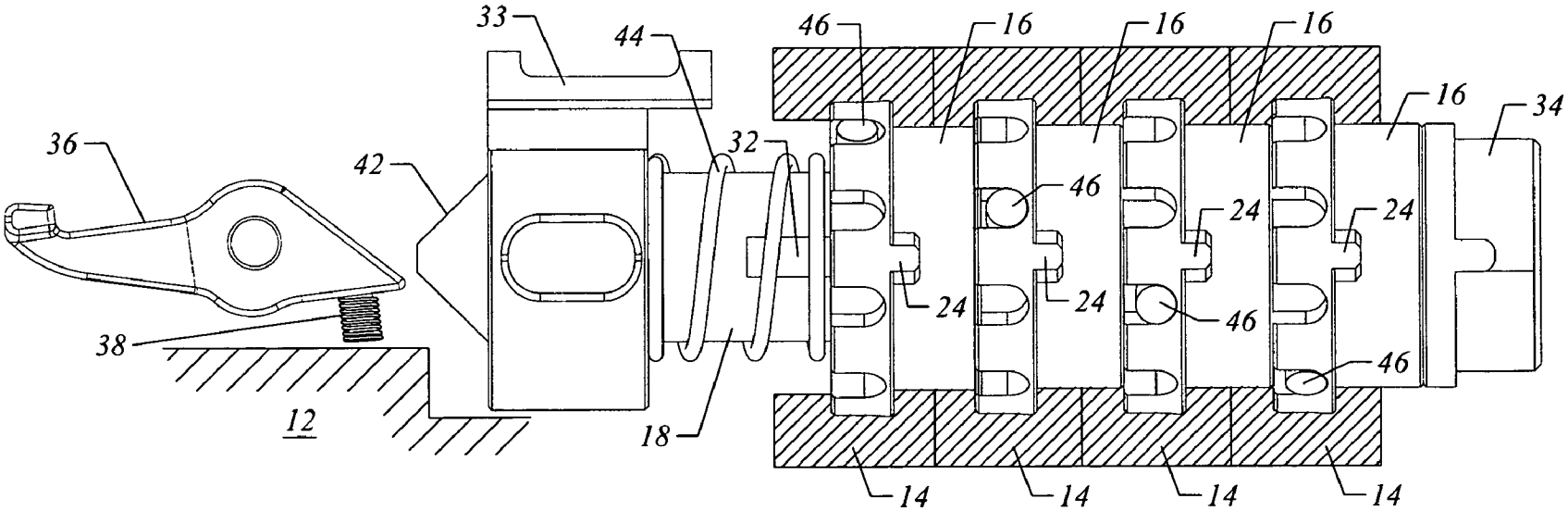
FIG. 9A is a view similar to FIGS. 7A and 8A with the lock in the unlocked position.
Figure 9B:
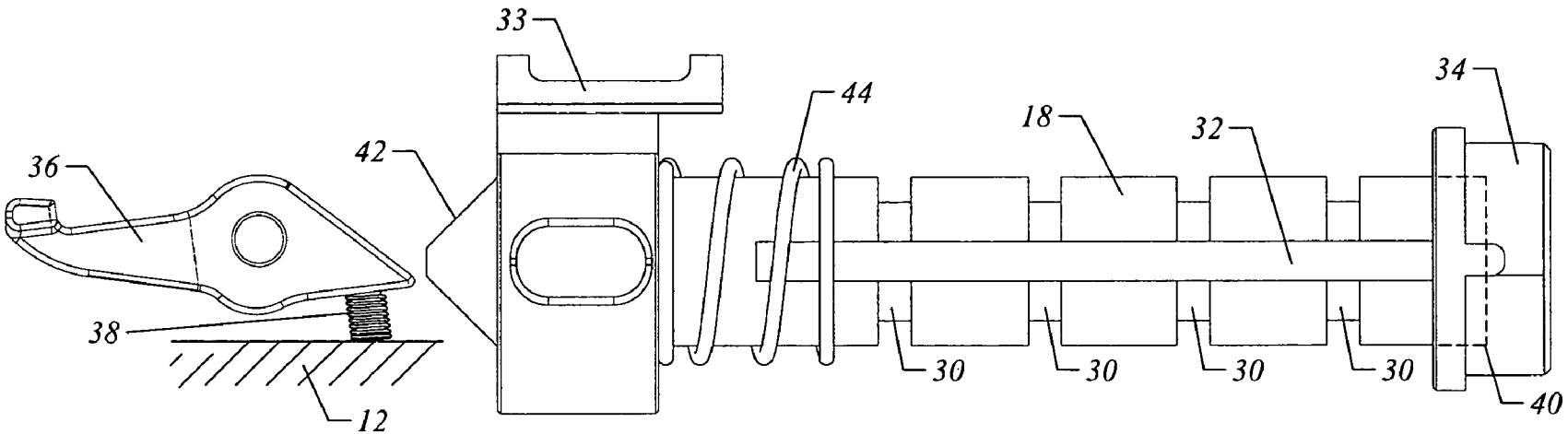
FIG. 9B is a view similar to FIGS. 7B and 8B with the lock in the unlocked position.

Referring to FIGS. 5 and 6, when the lock 10 is in the locked position, locking tab 28 of reset dial 16 is situated in rotating groove 30 of lock shaft 18. To unlock or reset the lock 10, a user rotates outer dials 14 to define the correct combination in the viewing area 20. Each locking tab 28 is then located at the intersection of one of the rotating grooves 30 and the release slot 32, allowing the lock 10 to be unlocked or reset, as will be described below. This position is defined as the unlocking position of each reset dial 16.

Referring to FIGS. 7A, 7B, 9A, and 9B, to unlock the lock 10, once the correct combination of outer dials 14, and thus the unlocking positions of reset dials 16, has been reached, the user slides lock shaft 18 to the rear of the lock 10 (right in, for example, FIGS. 7 and 9) by pulling back (right) on shaft button 33, which is attached to shaft 18 and protrudes from the top of lock housing 12. Outer dials 14, reset dials 16, and reset button 34 (which will be described below) stay in place. This movement allows locking arm 36 to pivot under force applied by unlocking spring 38 to unlock the lock 10. This movement is best seen by comparing FIGS. 7B and 9B, wherein it can be seen that the rear (right) end 40 of lock shaft 18 has moved from outside reset button 34 in FIG. 7B to inside reset button 34 in the unlocked position of FIG. 9B.

While exemplary embodiments of the present invention are illustrated with locking arm 36 and unlocking spring 38 as a representative locking mechanism actuated by the described dials 14, 16 and shaft 18, other alternative locking mechanisms may be used. The configuration of such alternative locking mechanisms is well within the ability of persons of ordinary skill in the art and the present invention is not limited to the locking arm 36 and unlocking spring 38 arrangement as illustrated in the exemplary embodiments. For example, in one alternative embodiment, cam surface 42 may be configured to mate directly with a cooperating receiver.

Referring now to FIGS. 7A, 7B, 8A, and 8B, to reset the combination, once the correct combination has been reached, a user presses reset button 34, which urges reset dials 16 forward (to the left in the FIGs.) against bias spring 44. Lock shaft 18 and outer dials 14 stay in place. The leftward movement of the reset dials 16 is best seen by comparing FIGS. 7A and 8A, the latter FIG. indicating the movement relative to outer dials 14 by distance "A." Reset dial keys 24 are thus disengaged from notches 26 in outer dials 14. Outer dials 14 are then free to rotate independently of reset dials 16 and can be set by the user to a new combination. Reset button 34 is then released. Reset dials 16 are biased back to their starting positions by means of bias spring 44, and become once again engaged with and rotatable with outer dials 14 by means of reset dial keys 24 in notches 26. When outer dials 14 are henceforth turned to the new combination, reset dials 16 are rotated along with them to their unlocking positions, allowing lock 10 to be unlocked or reset.

Referring again to FIG. 5, each reset dial 16 further includes a magnet 46 at a predetermined angular position relative to locking tab 28. The position of magnet 46 can be varied from reset dial to reset dial and from lock to lock; that is, a combination of magnet positions (hereinafter referred to as a master combination) is chosen for each lock 10 during manufacture. This allows for increased security by providing for several different master combinations.

Figure 10:
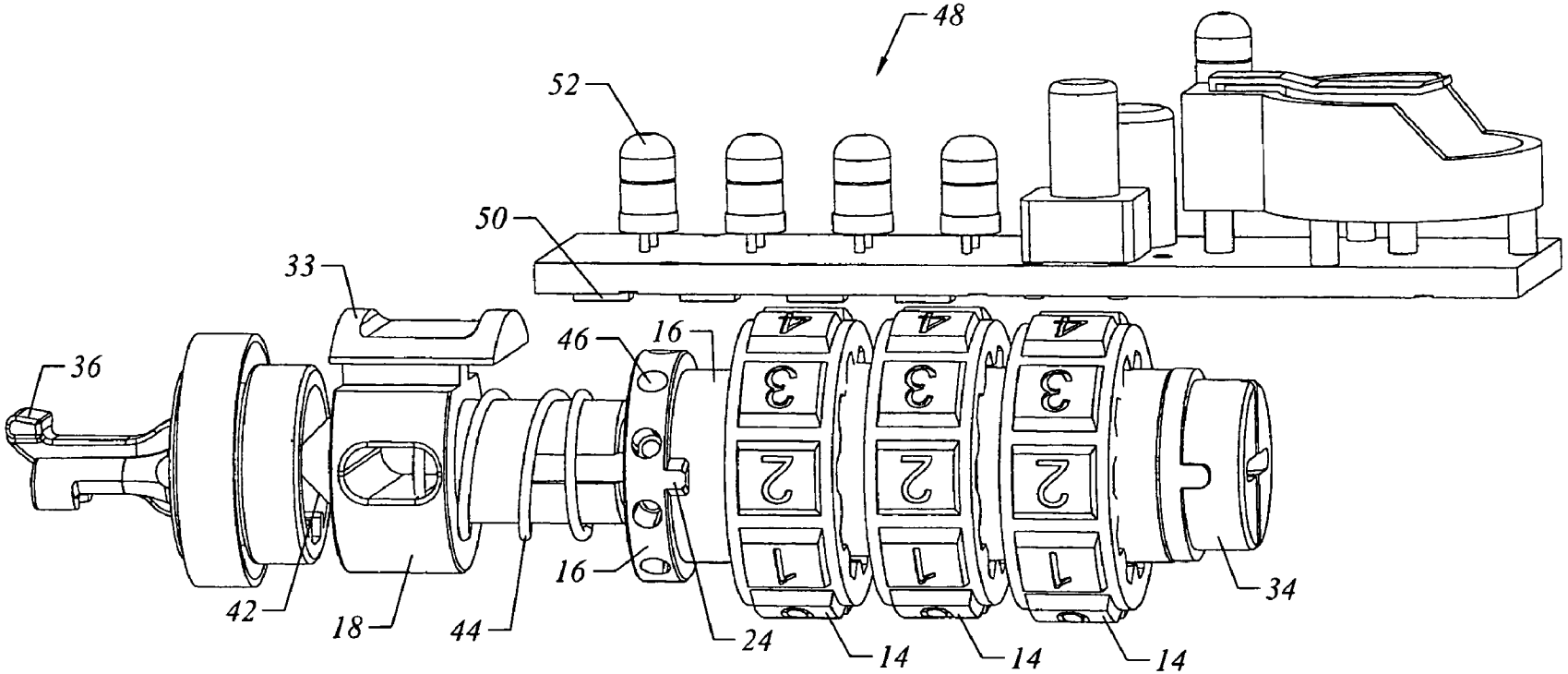
FIG. 10 is a perspective view of the lock and key of FIG. 1 with the lock housing and key housing removed.

Referring to FIG. 10, master key 48 may comprise sensors 50, positioned such that each sensor 50 cooperates with one reset dial 16 when master key 48 is placed in communication with lock 10. In an exemplary embodiment, master key 48 is secured to the lock 10, for example by a snap-on fitting. Other securement means are possible such as sliding engagement, guide pins, or detents. When each outer dial 14, and thus each reset dial 16, is rotated to a position in which its magnet 46 is adjacent a respective sensor 50 (in the illustrated embodiment, when magnet 46 is situated at the top of the lock 10), signal 52 indicates to the user that the baseline position for that reset dial 16 has been reached. When all signals have indicated baseline position to the user, it is known that all reset dials 16 are in their baseline positions. The user then applies the master combination by rotating each reset dial 16, via outer dial 14, according to the position of magnet 46. In the illustrated embodiment, because master key 48 is snapped to lock 10 at a position 90° from release slot 32 (see FIGS. 6 and 10), the user rotates each outer dial 14 the angular distance between magnet 46 and locking tab 28 plus 90°. The resultant positions of outer dials 14 define the lost combination.

In an exemplary embodiment, sensors 50 may comprise Hall effect sensors communicating with and activating light-emitting diodes (LEDs) 52 to provide the signal indicative of baseline position. Other sensor types, such as Reed sensors, and other signals, such as sounds, may also be used. Master key 48 also includes sensor circuits with a power source such as battery communication between sensors 50 and signals 52 as may be configured by a person of ordinary skill in the art based on the teachings herein.

The angular distance between possible magnet positions is preferably identical to the angular distance between numerals on the face of outer dial 14. A user thus applies the master combination by rotating each outer dial 14 an integer number of numeral positions. The master combination given to the user is thus a series of integers. For example, if outer dials 14 have numerals 0-9, the sequence of numerals in the viewing area 20 at baseline position may be 4-2-1-5. If the master combination for that lock is 3-7-8-2, the user rotates the first outer dial three numeral positions, from 4 to 7, the second dial from 2 to 9, and so on. After the user has applied the master combination, the forgotten combination, in this case 7-9-9-7, is shown in the viewing area 20 and reset dials 16 are all in their unlock positions.

In a further alternative embodiment, the master combination consists of zeros. Magnets 46 are positioned such that the baseline position itself defines the unlock position without further rotation of outer dials 14. For example, if master key 48 is secured to lock 10 90° from release slot 32, magnets 46 are 90° from locking tabs 28. When all signals 52 have signaled the user, reset dials 16 are in their unlock positions, and the combination seen in the viewing area 20 is the correct (lost) combination.

In a further alternative embodiment, key 48 includes magnets 46, and lock 10 includes sensors 50 and signals 52. The positions of sensors 50 relative to locking tabs 28 thus defines the master combination. Signals 52 may be on reset dials 16, outer dials 14, or on lock housing 12, and are in communication with sensors 50. Lock 10 may also include sensor circuits with a power source such as battery communication between sensors 50 and signals 52.

In a further alternative embodiment, lock 10 is not resettable. In this embodiment, separate outer dials 14 are not used. Instead, reset dials 16 have numerals on their surfaces visible at viewing area 20 and thus define the combination. In this embodiment, reset button 34, reset dial keys 24, and bias spring 44 need not be included.

Figure 11:
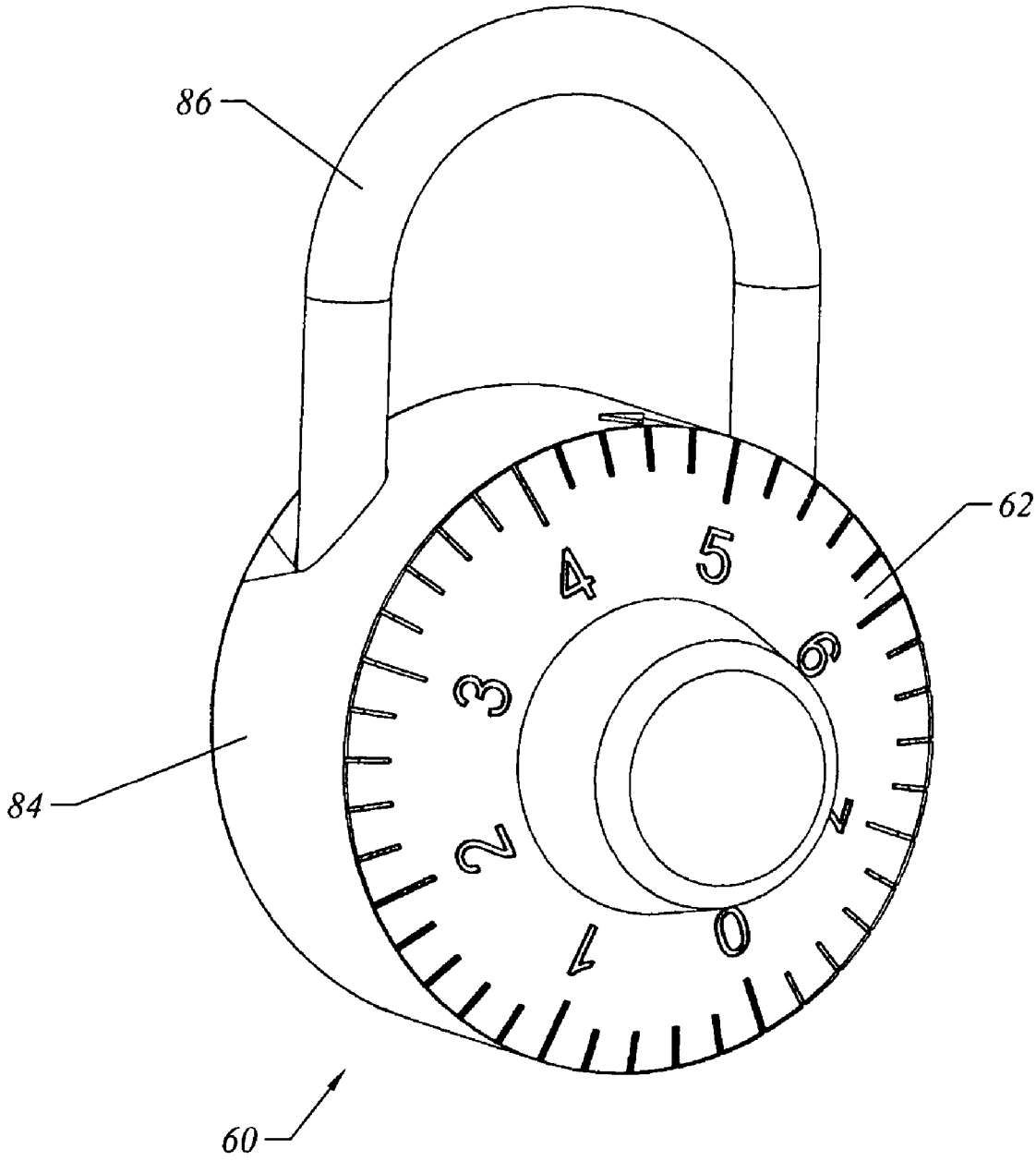
FIG. 11 is a perspective view of a lock according to an alternative embodiment of the present invention.

In other embodiments of the present invention, lock 60 is a rotary combination lock such as in FIG. 11. This embodiment provides a lock control member such as lever 80, plural combination members such as wheels 66 and drive cam 68, dial locking members such as notches 76 disposed on wheels 66 and drive cam 68, and a locking member such as hasp 86 or a bolt (not shown), first indicator elements such as magnets 88, and second indicator elements such as sensors 90.

Figure 12:
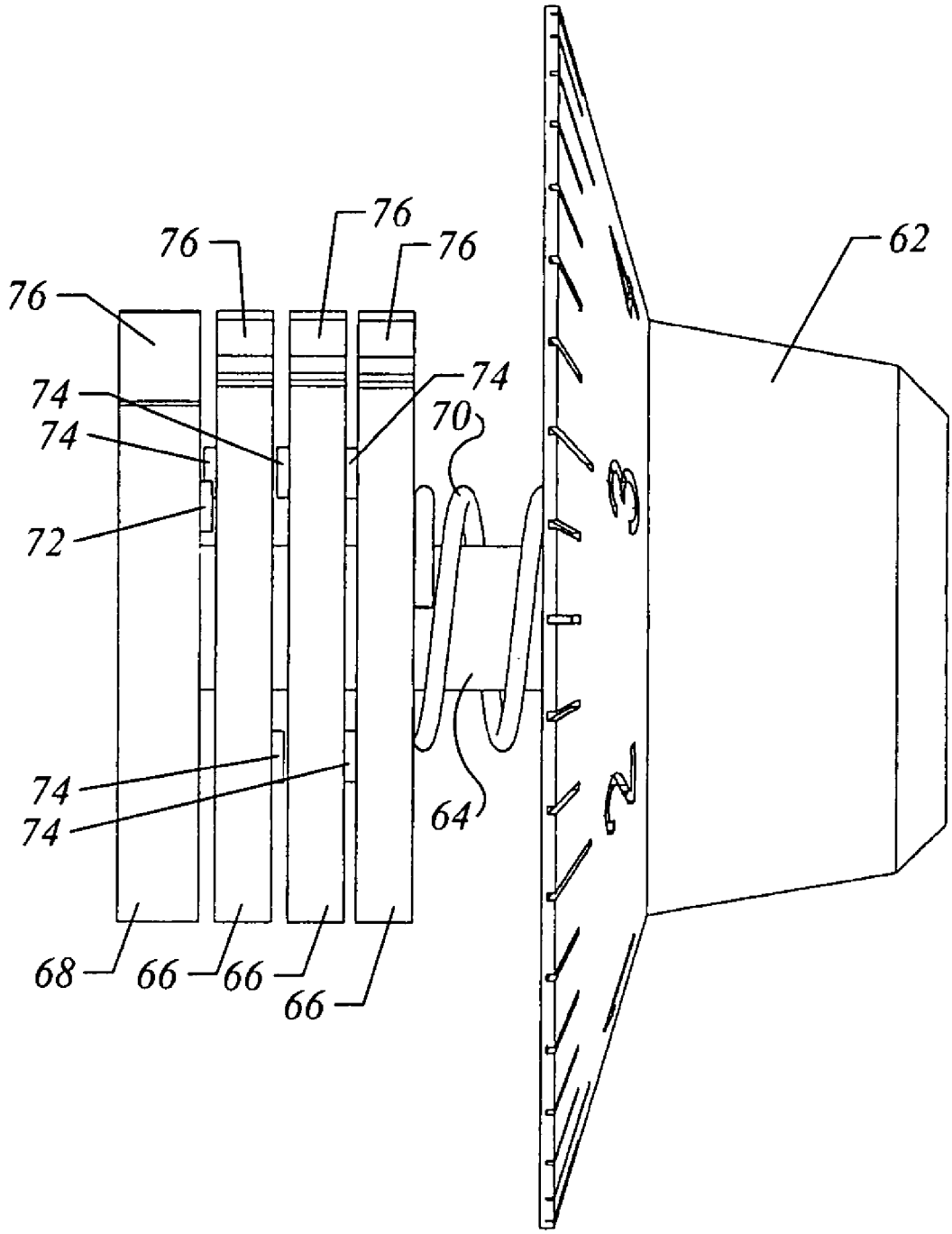
FIG. 12 is a side view of a dial, spindle, wheels, drive cam, and spring of the lock of FIG. 11.
Figure 13:
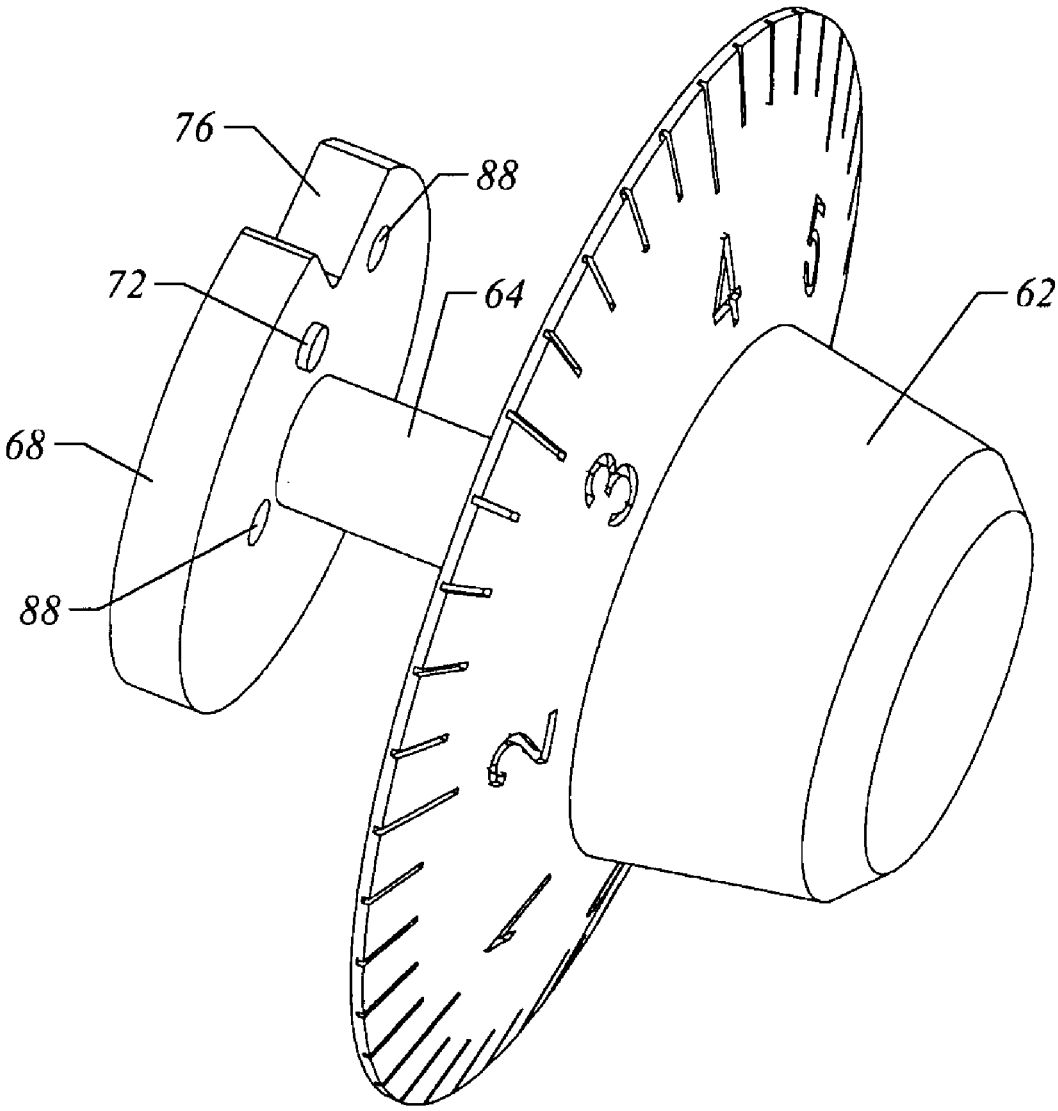
FIG. 13 is a perspective view of a dial, spindle, and drive cam of the lock of FIG. 11.
Figure 18:
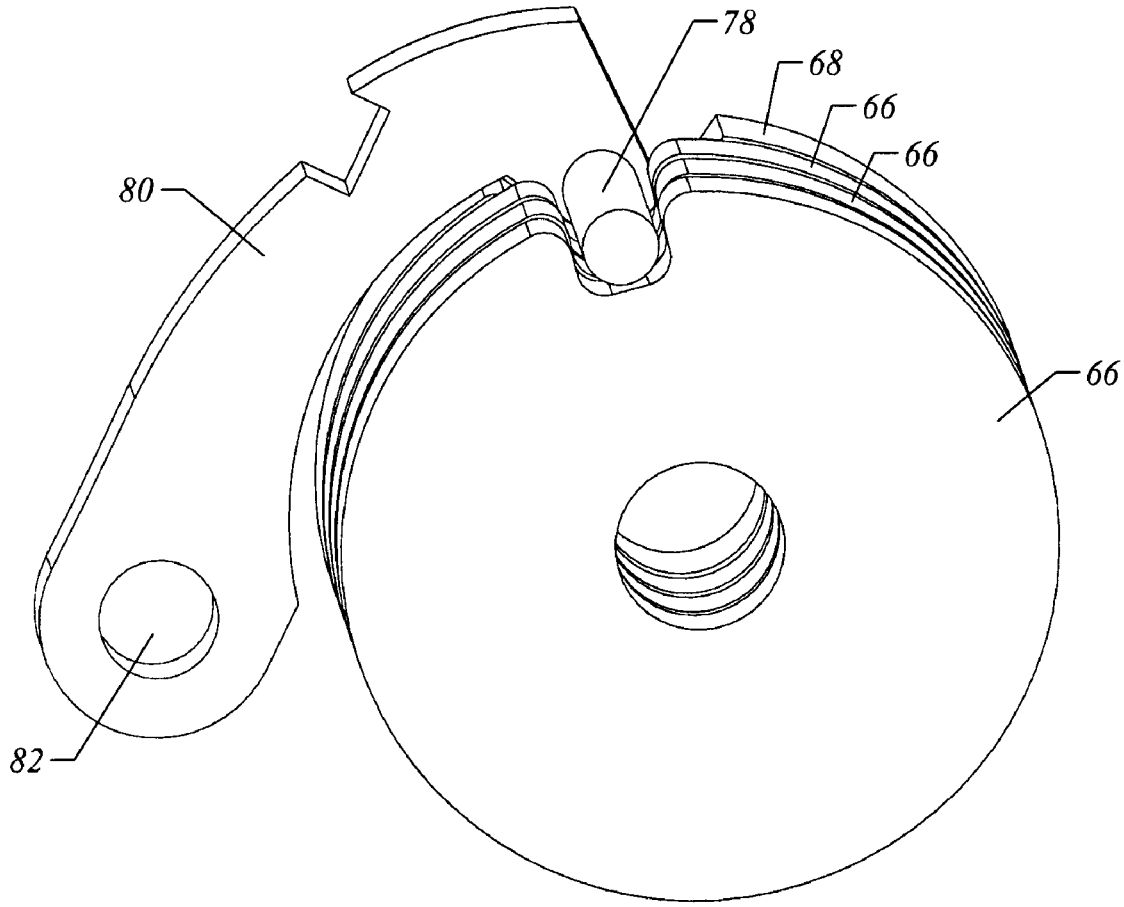
FIG. 18 is a front perspective view of the wheels, drive cam, and lever of the lock of FIG. 11.
Figure 19:
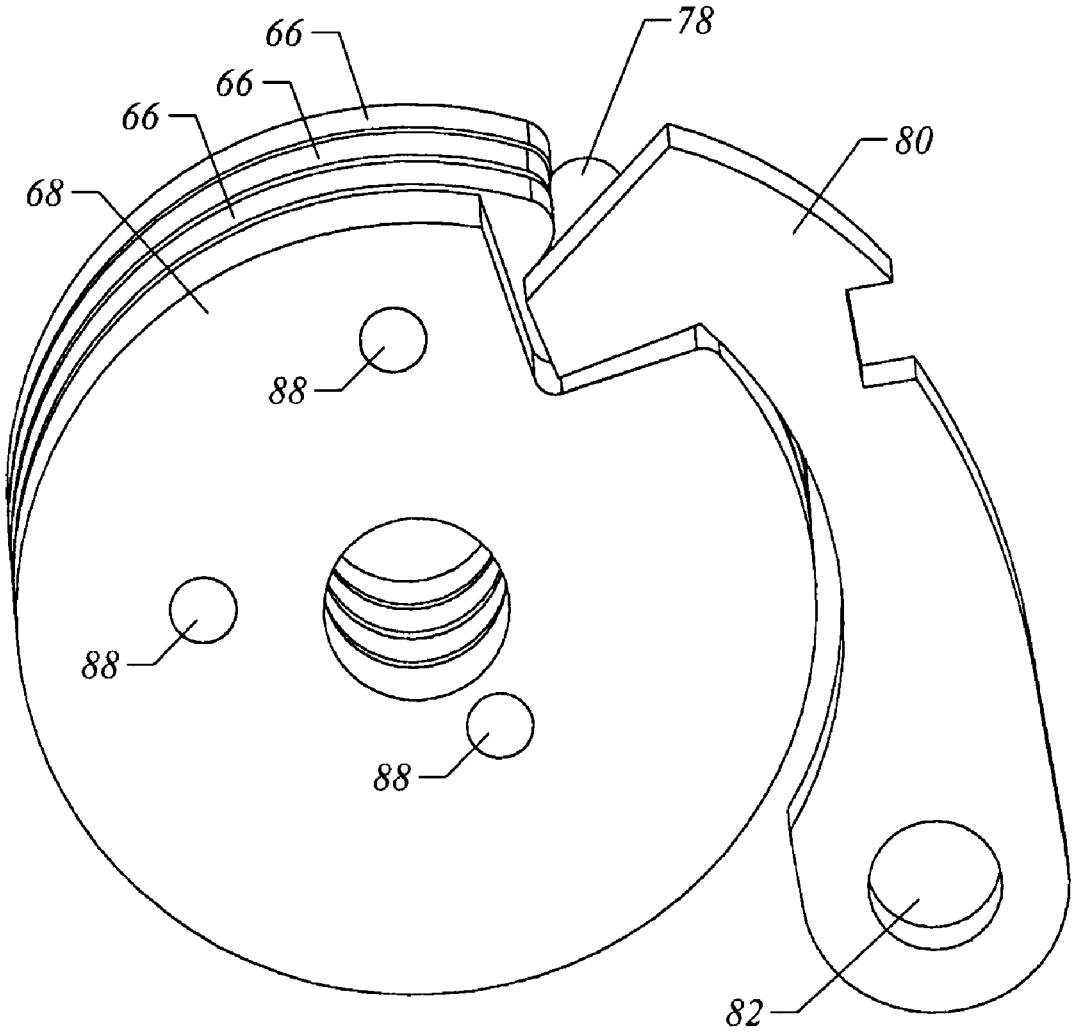
FIG. 19 is a rear perspective view of the wheels, drive cam, and lever of the lock of FIG. 11.
Figure 20:
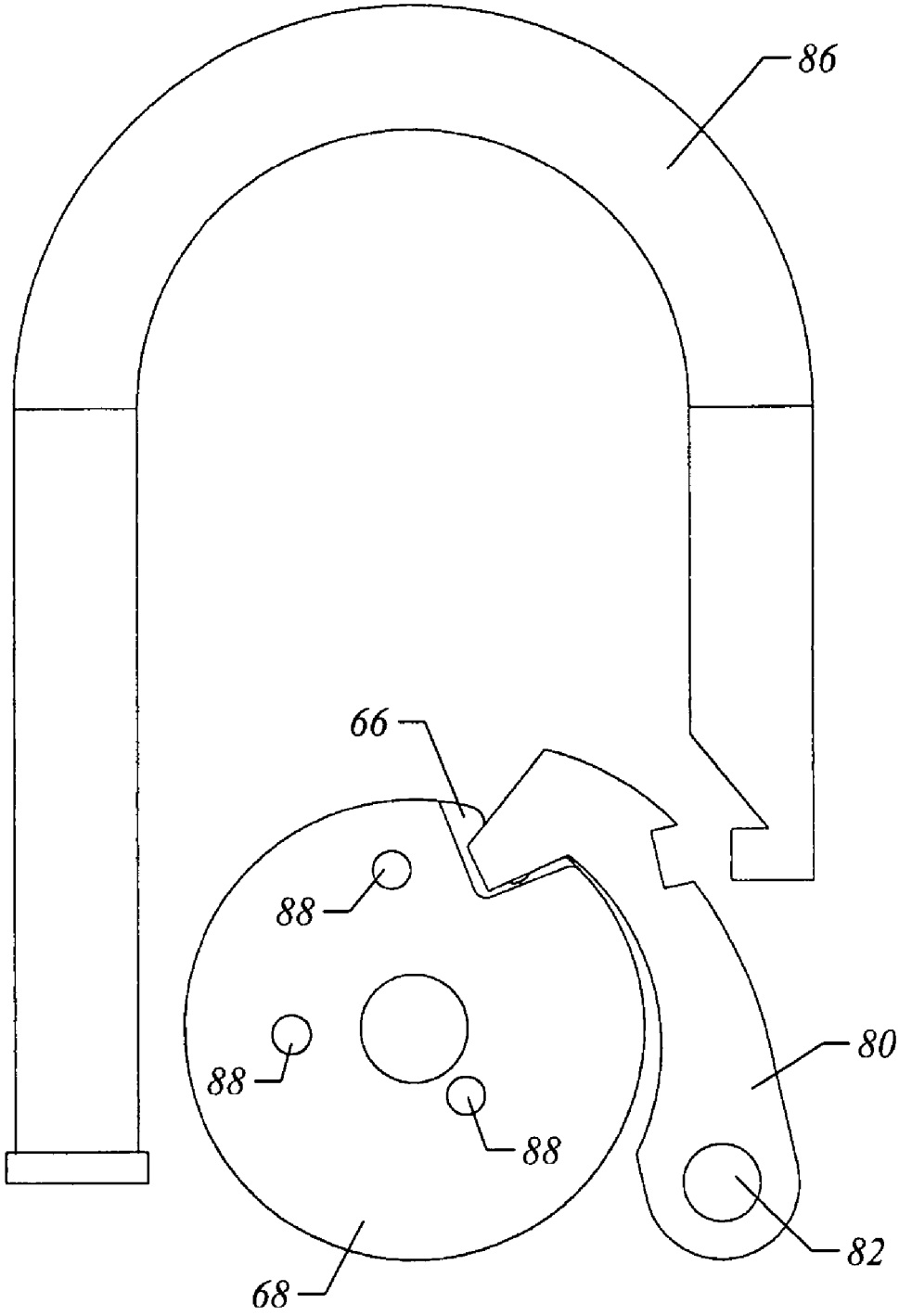
FIG. 20 is a rear view of the drive cam, wheels, lever, and hasp of the lock of FIG. 11.
Figure 21:
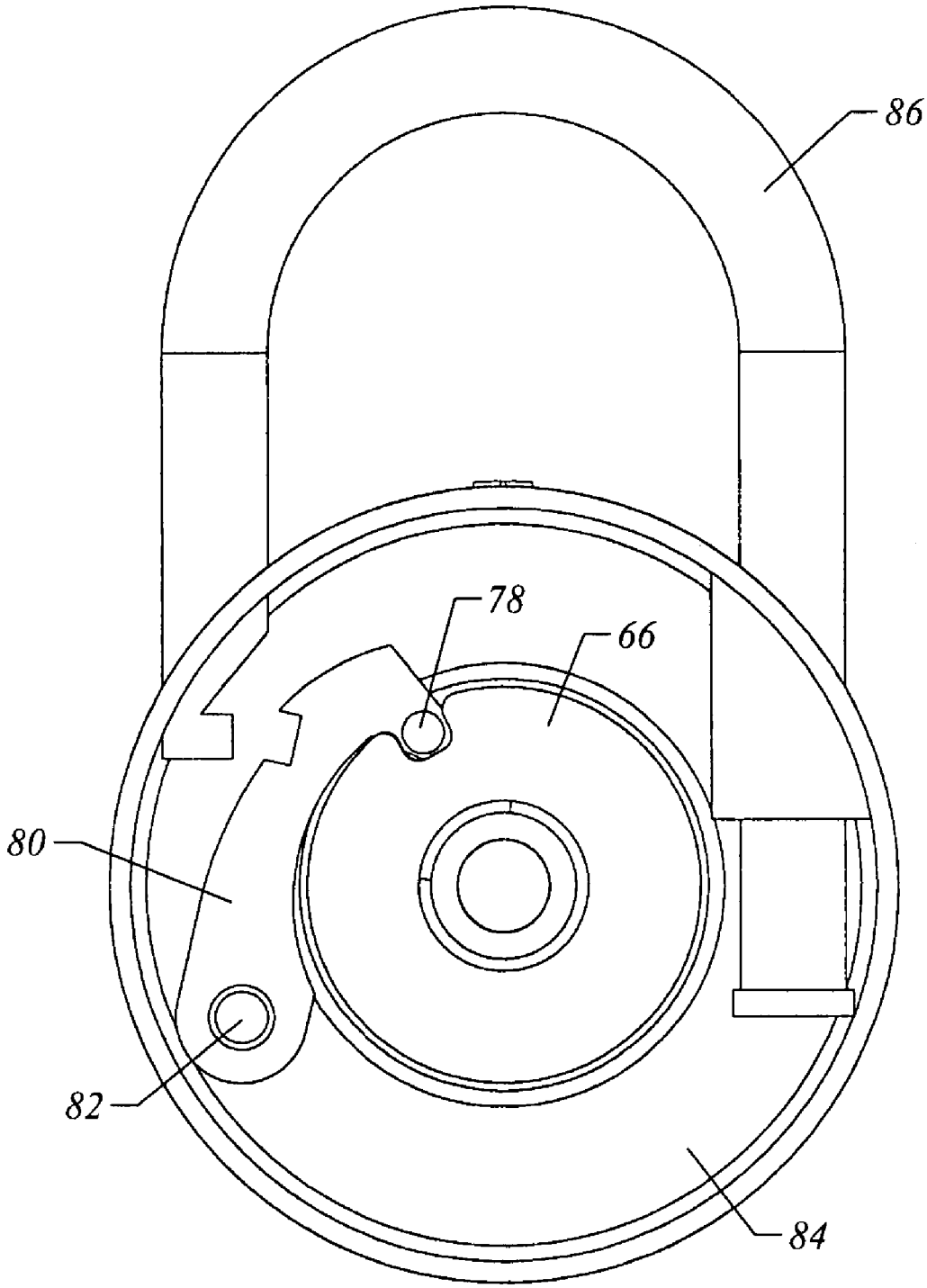
FIG. 21 is a front view of the wheels, lever, hasp, and lock housing of the lock of FIG. 11.

Referring to FIGS. 12 and 13, dial 62 is provided on spindle 64, which passes through clearance holes in wheels 66 and is connected to drive cam 68 behind wheels 66. Spring 70 presses wheels 66 and drive cam 68 together. Spacers (not shown) may additionally be provided between wheels 66 and between the rearmost wheel 66 and drive cam 68. In exemplary embodiments, lock 60 includes three wheels 66 and three numbers in the combination; however it will be appreciated that the scope of the invention is not limited thereto. Referring to FIGS. 14-17, to rotate the first (frontmost) wheel 66 to its unlocking position, a user rotates dial 62 two full rotations clockwise, and then keeps rotating dial 62 to the first number in the combination. During the first full rotation, drive pin 72 projecting from the front face of drive cam 68 engages with wheel fly 74 on the back face of the third (rearmost) wheel 66, which begins to rotate along with drive cam 68. This is referred to as "picking up" the third wheel 66. On the second full rotation, the second wheel 66 is picked up by wheel fly 74 on the front face of the third wheel 66, and when dial 62 is subsequently turned to the first number in the combination, the first wheel 66 is picked up and rotated to its unlocking position, which is defined as the position at which notch 76 is adjacent fence 78 of lever 80, which will be described below. The user then rotates dial 62 one full rotation counter-clockwise, picking up the third and then the second wheel 66, and keeps rotating dial 62 to the second number in the combination, at which point the second wheel 66 is in its unlocking position. The final number is then dialed clockwise, which rotates the third wheel 66 and the drive cam 68 to their unlocking positions. Referring to FIGS. 18 and 19, lever 80 now rotates by means of its own weight around pivot point 82, disposed on lock housing 84, until fence 78 is situated within notches 76. As best seen in FIGS. 20 and 21, this releases hasp 86, allowing lock 60 to be opened.

While exemplary embodiments are illustrated with lever 80 and hasp 86, other alternative locking mechanisms may be used. The configuration of such locking mechanisms is well within the ability of persons of ordinary skill in the art and the present invention is not limited to lever 80 and hasp 86 as illustrated in the exemplary embodiments. For example, in a safe-type lock, hasp 86 is not included, and fence 78 falling into notches 76 allows a bolt (not shown) to slide into the space previously inhabited by lever 80.

Figure 14:
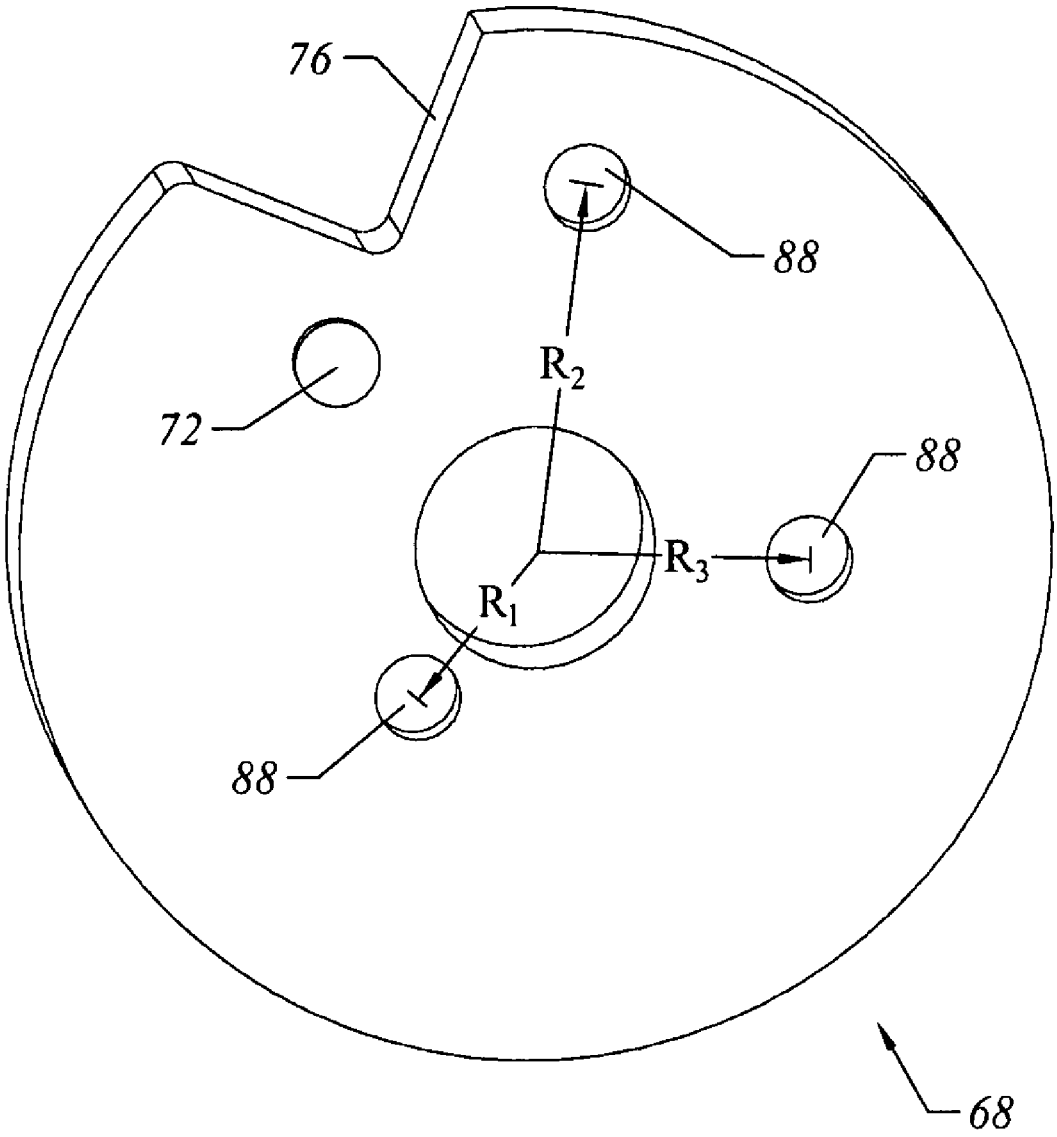
FIG. 14 is a front perspective view of a drive cam of the lock of FIG. 11.
Figure 15:
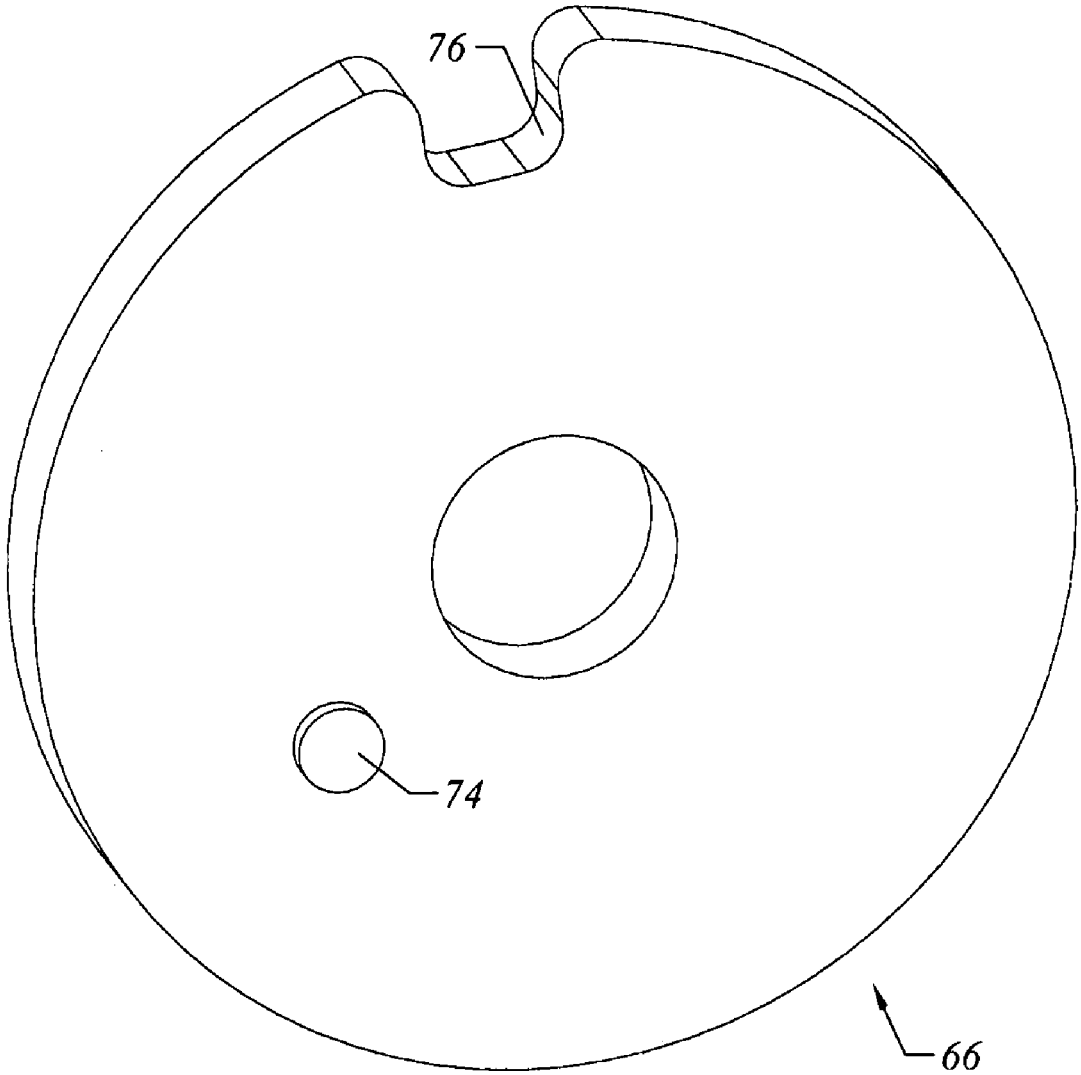
FIG. 15 is a front perspective view of a wheel of the lock of FIG. 11.
Figure 16:
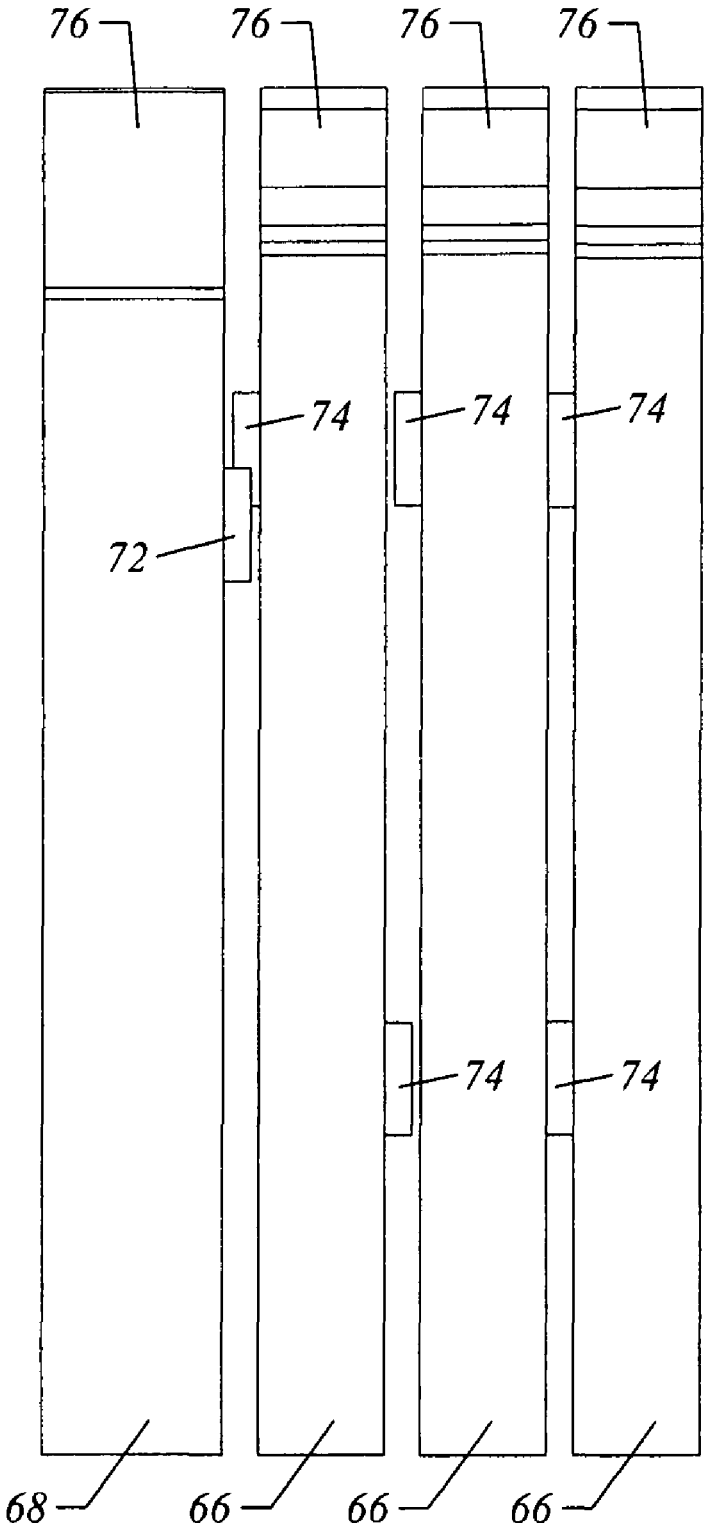
FIG. 16 is a side view of wheels and a drive cam of the lock of FIG. 11.
Figure 17:
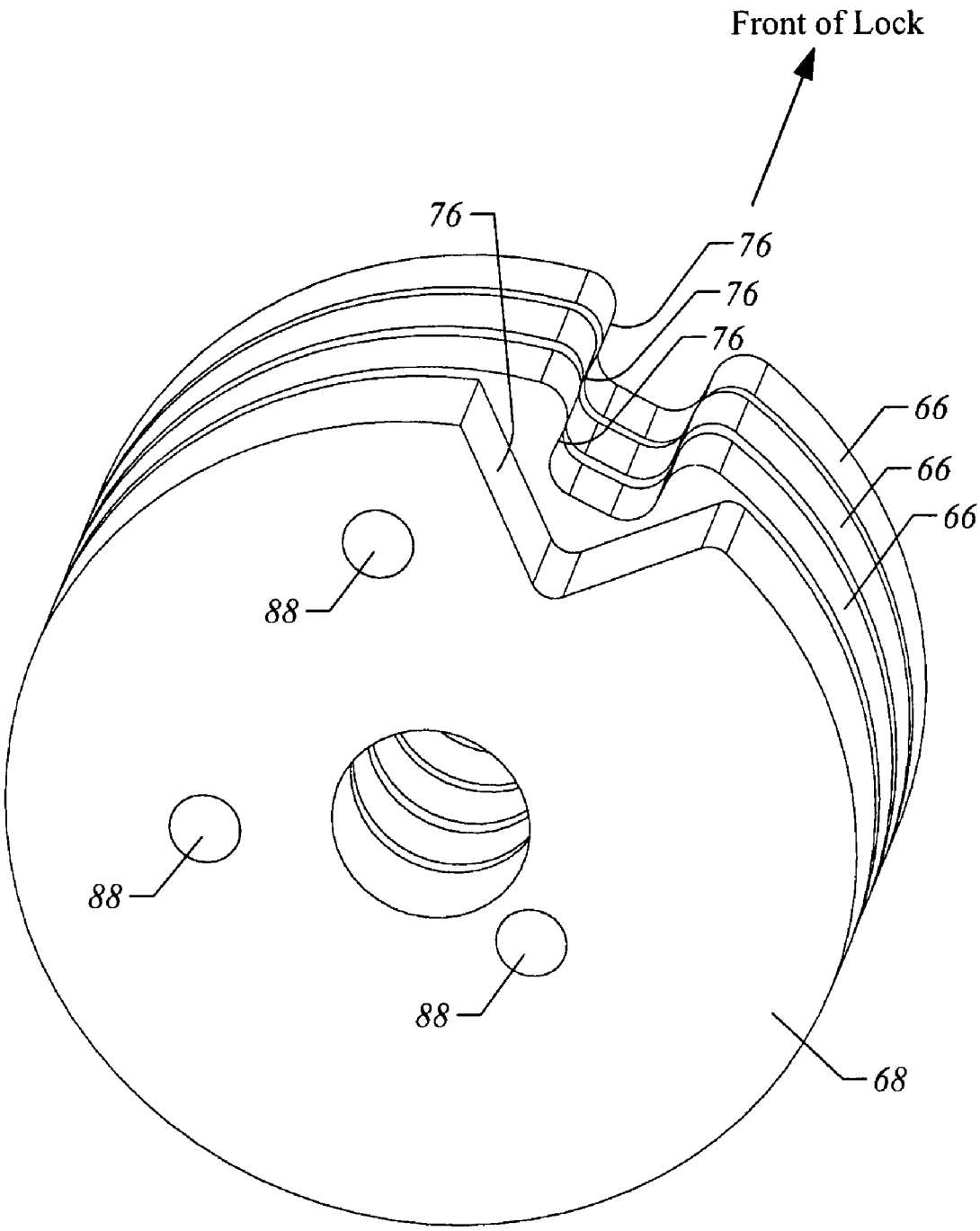
FIG. 17 is a rear perspective view of the wheels and drive cam of the lock of FIG. 11.
Figure 23:
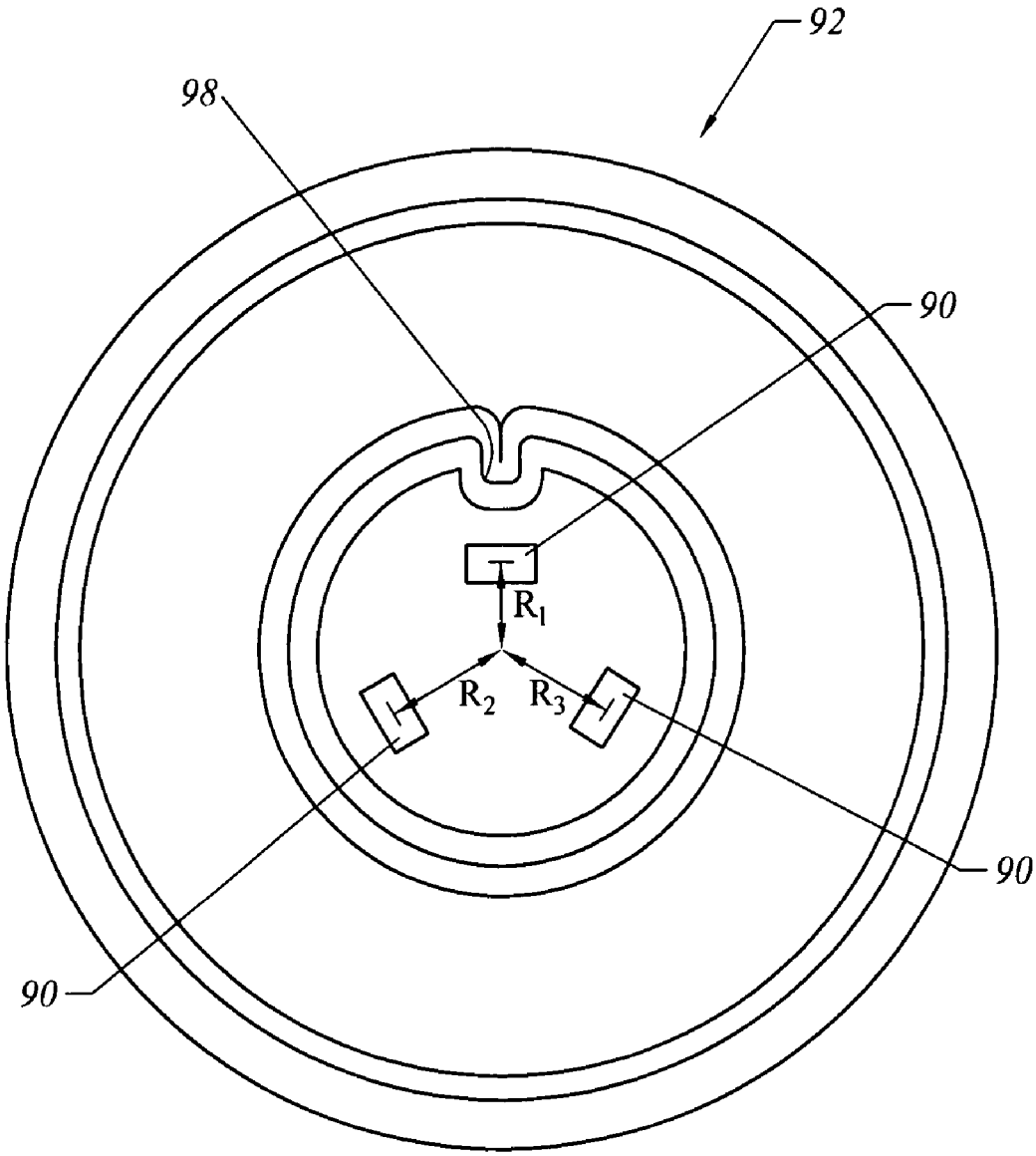
FIG. 23 is a front perspective view of a master key which corresponds to the lock of FIG. 11.
Figure 24:
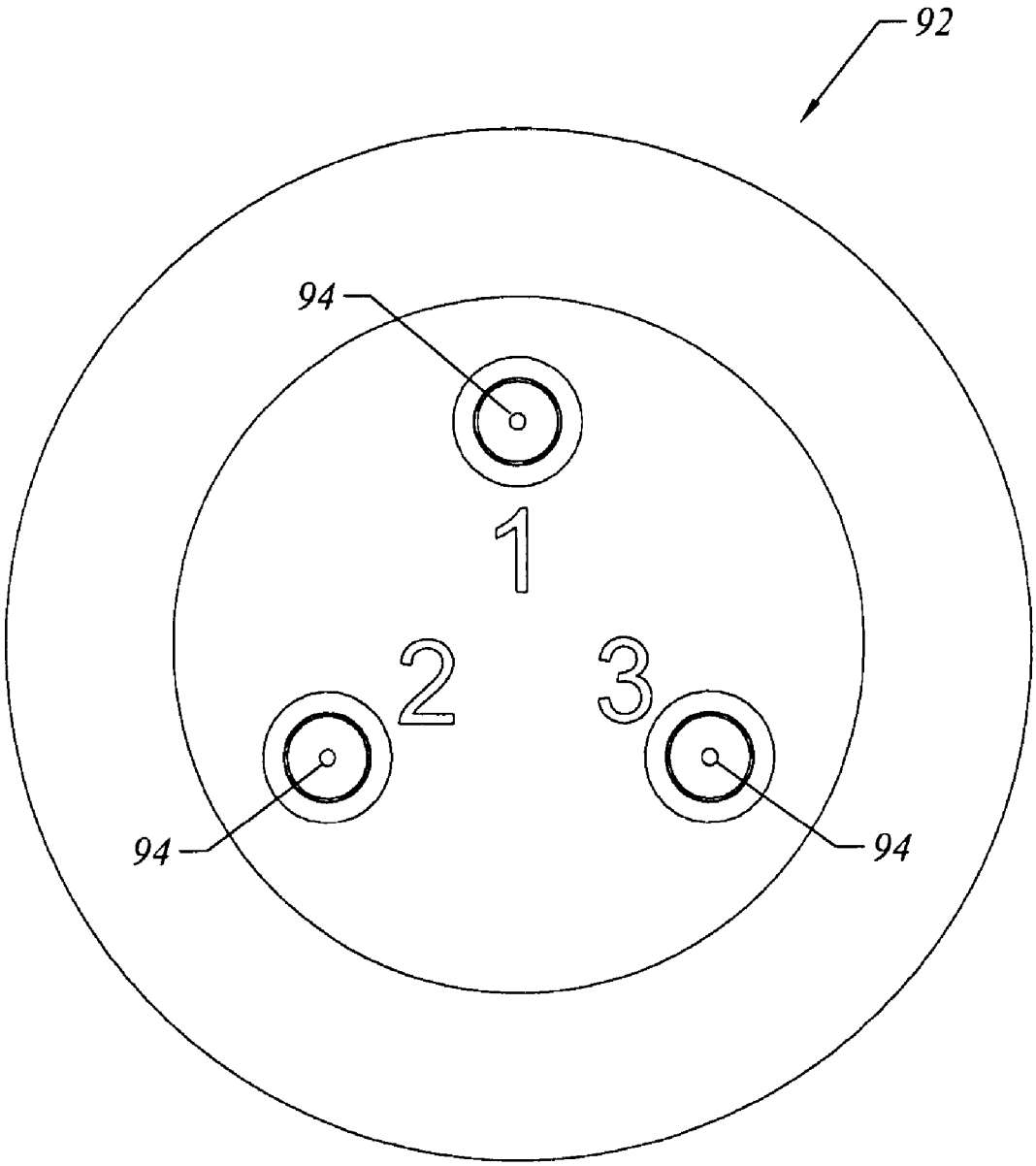
FIG. 24 is a rear view of the master key of FIG. 23.
Figures 1, 25A:
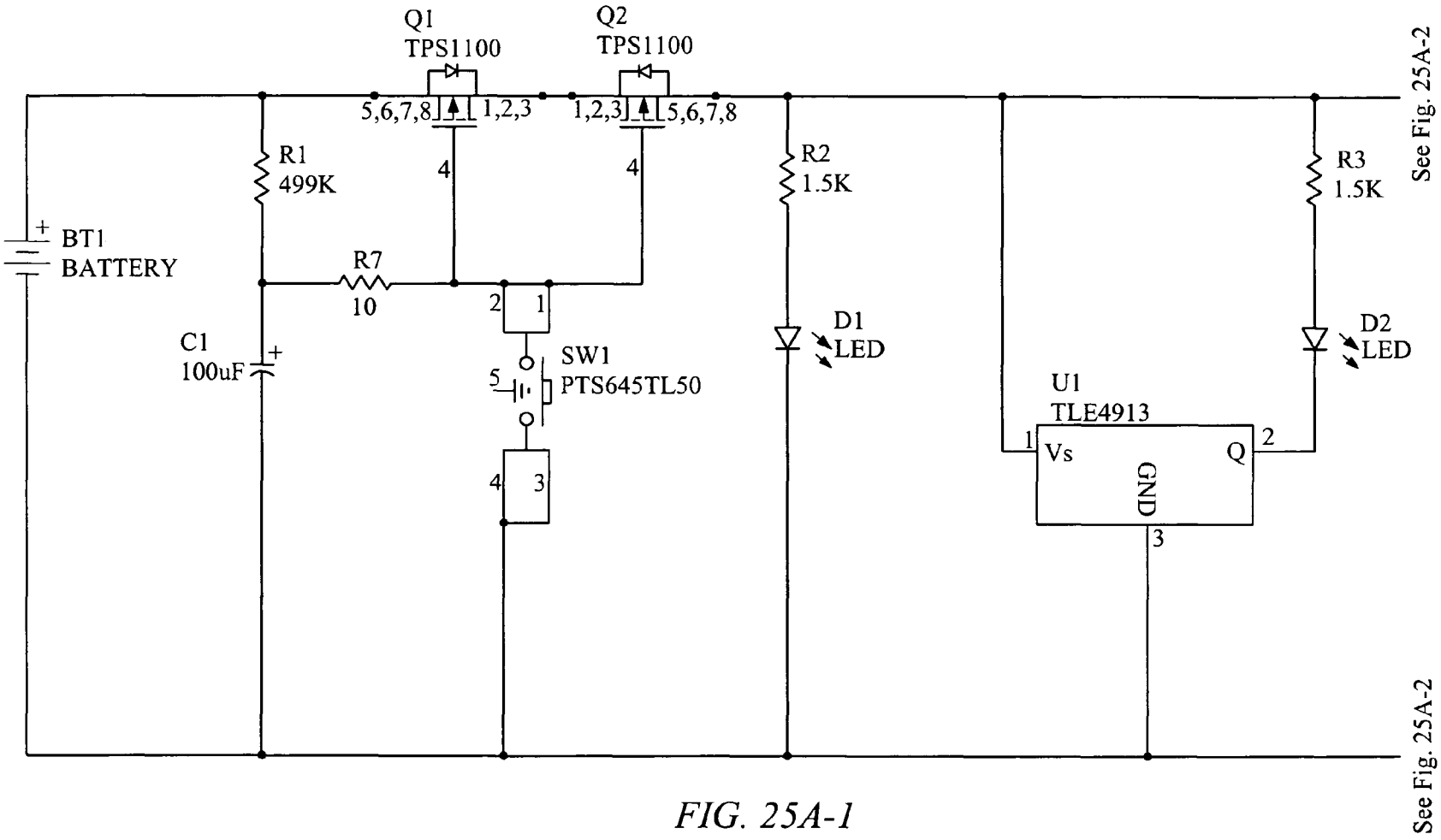
Figures 2, 25A:
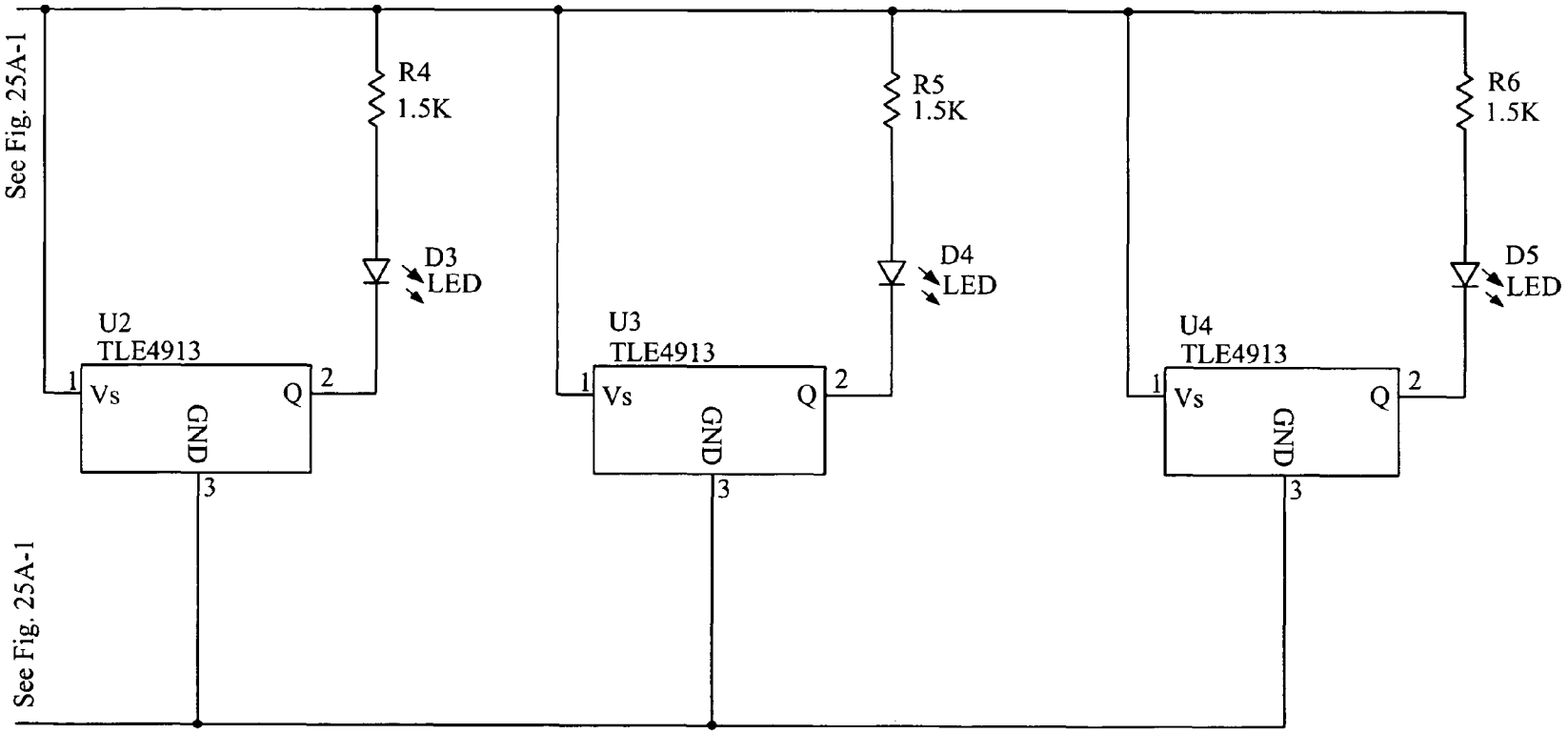
Figure 25B:
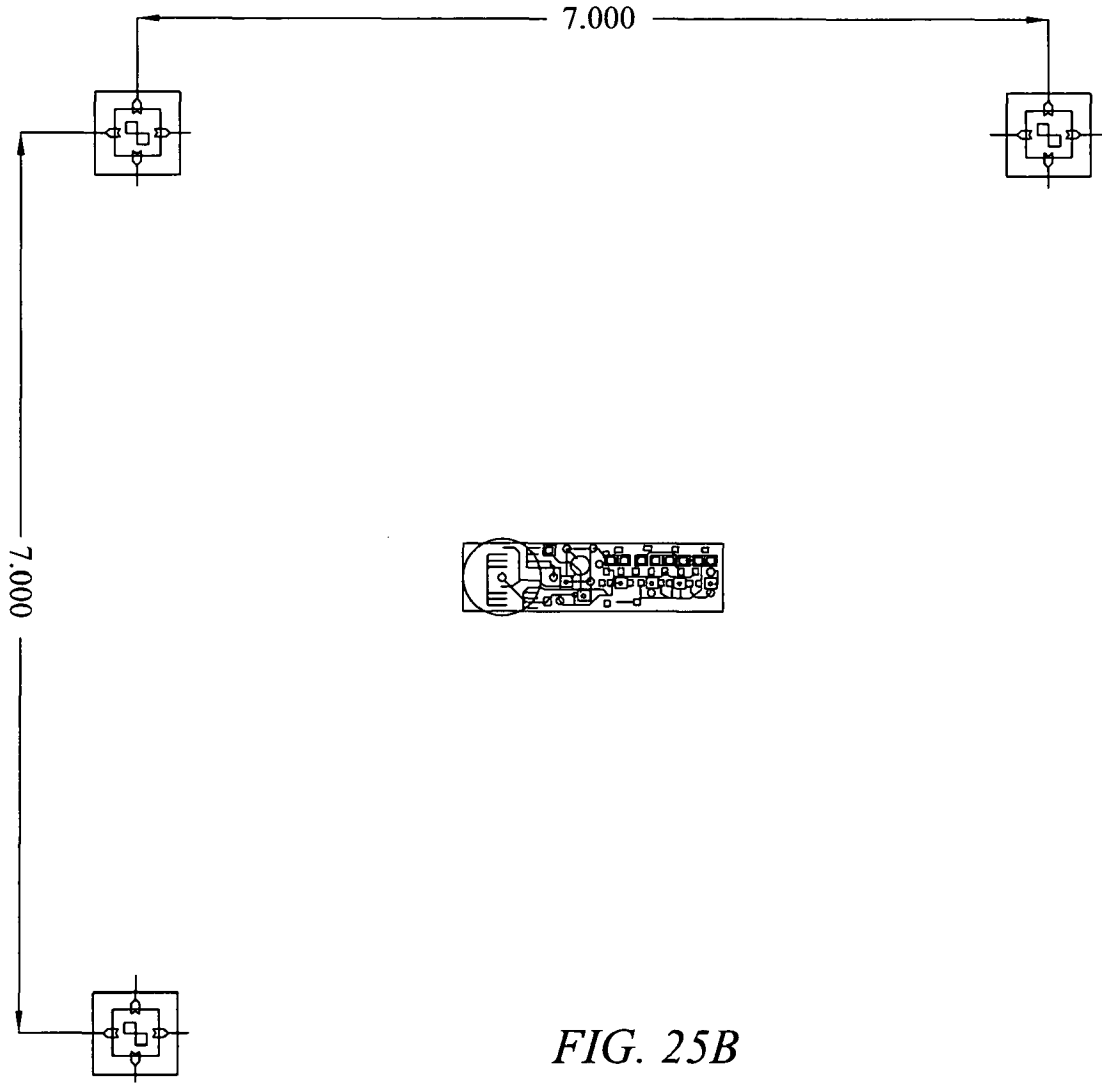
FIG. 25 is a schematic drawing of a printed circuit board for use in a master key according to embodiments of the present invention.

Referring now to FIGS. 14, 23, and 24, three magnets 88, one for each number in the combination, are provided on drive cam 68, each at a different radius $R_1$, $R_2$, $R_3$. Each magnet 88 communicates with one sensor 90 provided on master key 92, which also includes signals 94, sensor circuits, and a power source as described above. Signals 94 are numbered to allow a user to easily determine which signal 94 corresponds to which wheel 66; for example by providing numerals near the signals 94. Numeral "1" may correspond to the first wheel 66 and the first number in the combination, and so forth. The first magnet 88's position is such that it is adjacent the first sensor 90 when the first wheel 66 has been picked up and dialed to its baseline position. Since the first magnet 88 and the first sensor 90 are at a unique radius $R_1$, the first sensor 90 communicates only with the first magnet 88, and the first signal 94 signals proximity of only the first magnet 88. The same is true for the second and third sets of magnets 88 and sensors 90 at unique radii $R_2$ and $R_3$.

Recovery of a lost combination for rotary lock 60 will now be described. For purposes of this discussion, rotating "forward" refers to rotating dial 62 clockwise for the first wheel 66, counter-clockwise for the second wheel 66, and clockwise for the third wheel 66. Rotating "backward" refers to the opposite direction.

Figure 22:
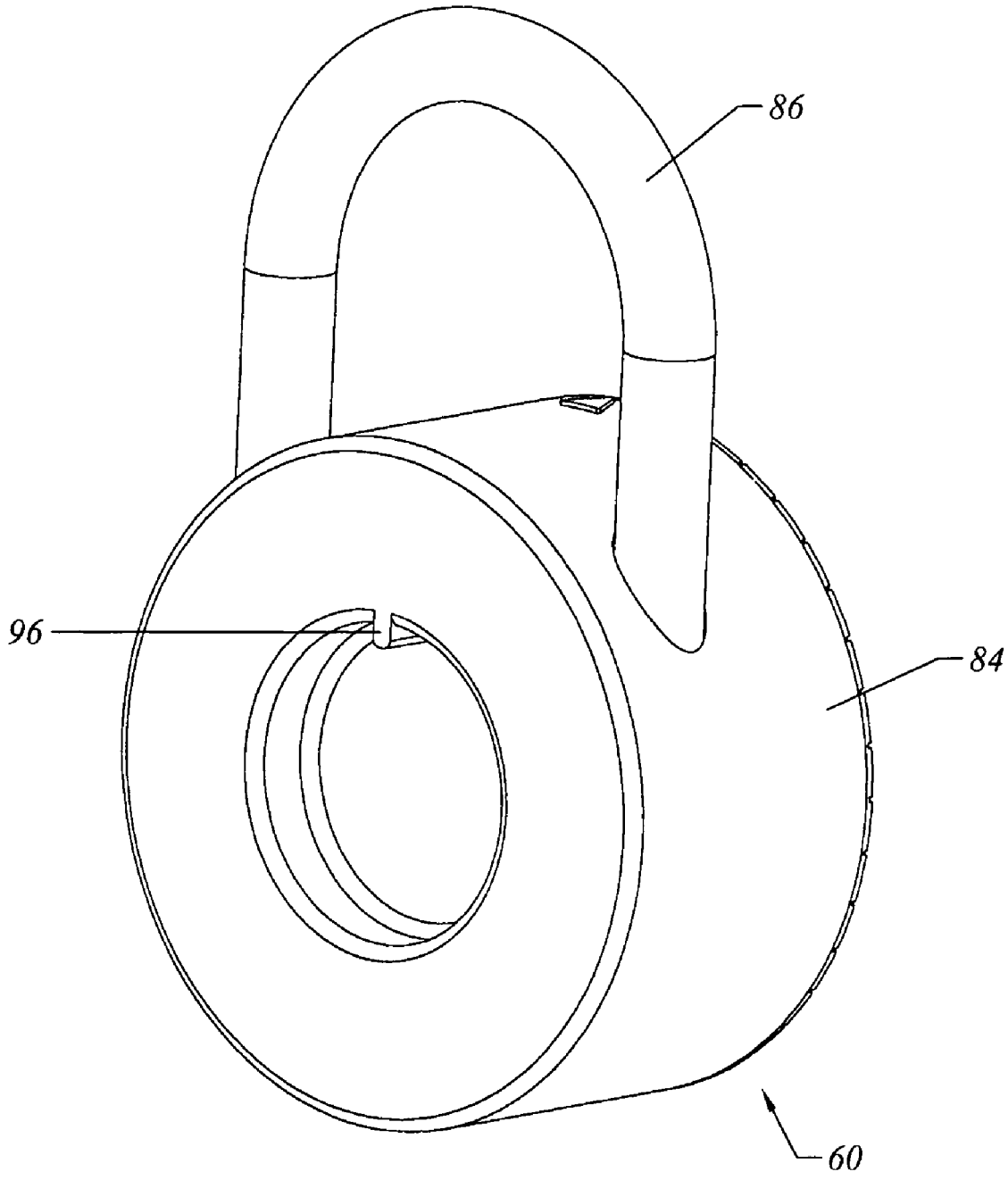
FIG. 22 is a rear perspective view of the lock of FIG. 11.

To recover a lost combination, a user places master key 92 in communication with lock 60, for example by a snap-on fitting with tab 96 on the back of lock 60 inserted to notch 98 on the front of key 92 as seen in FIGS. 22 and 23. Alternatively, key 92 may fit over dial 62 and attach to lock housing 84 or to the front surface of a door to a safe on which lock 60 is provided. The user then rotates dial 62 more than two full rotations clockwise until the first signal 94 signals that the first wheel 66 is in its baseline position, then keeps rotating dial 62 forward according to the first number in the master combination, at which point the first wheel 66 is in its unlocking position. The user repeats this process for each wheel 66, at which point the lost combination has been dialed.

While such a recovery process is preferable in ease of use, a master combination for such a process must involve forward rotation only, and such forward rotation must not progress far enough that the next wheel 66 is picked up and rotated out of its unlocking position.

In an alternative embodiment of recovering a lost combination, a user first rotates dial 62 one full rotation, while monitoring all three signals 94 and taking note of all three baseline positions. The master combination is then applied mentally before the user begins to dial the combination. Forward and backward rotation in the master combination are manifested as addition and subtraction to the number shown on the dial 62 at each baseline position, and the lost combination is calculated by the user rather than found on the dial 62 itself. Such a method allows for a greater number of possible master combinations, since backward rotation, and forward rotation farther than that in the previous embodiment, can be used without rotating wheels 66 out of their unlocking positions.

In a further alternative embodiment, the master combination consists of zeros. Signals 94 and magnets 88 are positioned such that the baseline position itself defines the unlocking position without further rotation. A user thus rotates dial 62 two full rotations, and keeps rotating until the first signal 94 signals that the first number in the combination has been found, then repeats the process for the second and third numbers in the combination.

In a further alternative embodiment, rotary lock 60 may be resettable. Wheels 66 and drive cam 68 may contain inner and outer wheels, separable from one another along the axis of spindle 64. Dial 62 may rotate the inner wheel of drive cam 68, and drive pin 72 and wheel flies 74 may be disposed on the inner wheels, which may selectively rotate the outer wheels with reset dial keys. Magnets 88 may be provided on the outer wheels, each at a specific angular distance from notch 76, this distance defining the master combination.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A combination lock, comprising:

a housing;

a lock control member moveable within the housing between at least a first locking position and a second open position;

plural combination members, positionable within the housing by a user in plural locked positions and at least one unlocking position corresponding to a preset combination, said combination members cooperating with the lock control member to permit movement to said second open position when said combination members are positioned in said unlocking position;

a locking member secured in a locked state by the lock control member in the first locked position and being moveable to an unlocked state when the lock control member is in the second open position; and at least one indicator element disposed on at least one said combination member corresponding to a baseline position of one of said combination members wherein said baseline position is correlated to the preset combination by a preset master combination, further wherein said at least one indicator element comprises a magnet.

2. A lock as in claim 1, wherein the preset combination comprises a user-changeable combination.

3. A lock as in claim 1, wherein:

said lock control member comprises a lock shaft; and each of said plural combination members comprises a first dial selectively rotatable around said lock shaft between said locked positions and said unlocking position;

wherein said combination members are rotatable when said lock shaft is in said first locking position.

4. A lock as in claim 3, wherein, when said first dials are in said unlocking position, said lock shaft is slidable with respect to said first dials between said first locking position and said second open position.

5. A lock as in claim 3, wherein the preset combination includes a user-changeable combination, further comprising:

plural second dials, wherein positioning of each of said second dials selectively positions a respective one of said first dials.

6. A lock as in claim 5, wherein each of said second dials is selectively engaged with a respective one of said first dials to position said respective first dial.

7. A lock as in claim 6, further comprising a reset member, positionable by said user to slide said first dials along said lock shaft out of engagement with said second dials when said lock shaft is in said first locking position and said first dials are in said unlocking position.

8. A lock as in claim 7, wherein said first dials are biased into engagement with said second dials.

9. A lock as in claim 3, wherein each of said first dials comprises a dial locking member, which is at a predetermined angular position when said first dial is at said unlocking position, and wherein a position of each of said indicator elements comprises a predetermined angular distance from said dial locking member, and wherein said master combination is determined by said predetermined angular distance.

10. A lock as in claim 1, wherein said combination members comprise at least one wheel and at least one drive cam, rotatably positionable around a spindle between said locked position and said at least one unlocking position.

11. A lock as in claim 10, wherein each of said indicator elements is disposed at a unique radial distance from a center of rotation of said wheel or said drive cam.

12. A lock as in claim 10, wherein said indicator elements are disposed on said drive cam.

13. A combination of a combination lock and a master key, said combination lock comprising:

a housing;

a lock control member moveable within the housing between at least a first locking position and a second open position;

plural combination members, positionable within the housing by a user in plural locked positions and at least one unlocking position corresponding to a preset combination, said combination members cooperating with the lock control member to permit movement to said second open position when said combination members are positioned in said unlocking position;

a locking member secured in a locked state by the lock control member in the first locked position and being moveable to an unlocked state when the lock control member is in the second open position; and at least one first indicator element disposed on at least one said combination member corresponding to a baseline position of said combination members wherein said baseline position is correlated to the preset combination by a preset master combination;

said master key comprising:

second indicator elements, each in communication with a respective one of said first indicator elements, forming a pair of indicator elements;

wherein each pair of indicator elements comprises one magnet and one sensor;

said combination of said combination lock and said master key further comprising plural signals, each signal being disposed on either said combination lock or on said master key, and being in communication with said sensor of a respective one of said pairs of indicator elements;

wherein each of said signals indicates to said user whether or not said sensor of said respective one of said pairs is in proximity to said magnet of said respective one of said pairs.

14. A combination of a combination lock and a master key as in claim 13, wherein said preset combination comprises a user-changeable combination.

15. A combination of a combination lock and a master key as in claim 13, wherein said first indicators comprise magnets and said second indicators comprise sensors.

16. A combination of a combination lock and a master key as in claim 13, wherein said signals are disposed on said master key.

17. A combination of a combination lock and master key as in claim 13, wherein said signals comprise LEDs.

18. A combination lock, comprising:

a housing;

a lock shaft slidable within the housing between at least a first locking position and a second open position;

plural first dials, rotatable around said lock shaft by a user in plural locked positions and at least one unlocking position corresponding to a preset combination, said first dials cooperating with the lock shaft to permit sliding of said lock shaft to said second open position when said first dials are positioned in said unlocking position;

a locking member secured in a locked state by the lock shaft in the first locked position and being moveable to an unlocked state when the lock shaft is in the second open position; and at least one indicator element disposed on at least one said first dial corresponding to a baseline position of said first dial wherein said baseline position is correlated to the preset combination by a preset master combination, further wherein said at least one indicator element comprises a magnet.

19. A lock as in claim 18, wherein the preset combination comprises a user-changeable combination.

20. A lock as in claim 19, further comprising:

plural second dials, wherein positioning of each of said second dials selectively positions a respective one of said first dials.

21. A lock as in claim 20, wherein each of said second dials is selectively engaged with a respective one of said first dials to position said respective first dial.

22. A lock as in claim 21, further comprising a reset member, positionable by said user to slide said first dials along said lock shaft out of engagement with said second dials when said first dials are in said unlocking position and said lock shaft is in said first locking position.

23. A lock as in claim 22, wherein said first dials are biased into engagement with said second dials.

24. A lock as in claim 18, wherein each of said first dials comprises a dial locking member, which is at a predetermined angular position when said first dial is at said unlocking position, wherein a position of each of said indicator elements comprises a predetermined angular distance from said dial locking member, and wherein said master combination is determined by said predetermined angular distance.

25. A combination lock, comprising:

a housing;

a lever, pivotable within the housing between at least a first locking position and a second open position;

a drive cam, rotatable around a spindle and rotatably connected to a dial, said dial being rotatable by a user;

at least a first wheel, selectively rotatable around said spindle in response to rotation of said drive cam, in plural locked rotational positions and at least one unlocking rotational position corresponding to a preset combination, said wheel and said drive cam cooperating with the lever to permit pivoting of said lever to said second open position when said wheel and said drive cam are positioned in said unlocking position;

a locking member secured in a locked state by the lever in the first locked position and being moveable to an unlocked state when the lever is in the second open position; and at least one indicator element disposed on at least one of said drive cam and said at least one wheel corresponding to a baseline position of said wheel or said drive cam wherein said baseline position is correlated to the preset combination by a preset master combination, further wherein said at least one indicator element comprises a magnet.

26. A combination lock as in claim 25, further comprising at least a second wheel, wherein said first wheel is rotated by said drive cam and said second wheel is rotated by said first wheel.

27. A combination lock as in claim 25, wherein each of said indicator elements is disposed at a unique radial distance from a center of rotation of said wheel or said drive cam.

28. A combination lock as in claim 25, wherein said indicators are disposed on said drive cam.

29. A lock as in claim 25, wherein said locking member comprises a hasp.

30. A combination lock, comprising:

a means for locking and unlocking said lock;

plural means for embodying a preset combination of said lock, positionable by a user in plural locked positions and at least one unlocking position corresponding to said preset combination, said means for embodying a preset combination of said lock cooperating with said means for locking and unlocking said lock to permit said unlocking when said means for embodying said preset combination are positioned in said unlocking position; and at least one means for indicating a baseline position, disposed on at least one said means for embodying said preset combination, wherein said baseline position is correlated to said preset combination by a preset master combination, further wherein said at least one means for indicating said baseline position comprises a magnet.

31. A combination lock as in claim 30, wherein said means for locking and unlocking said lock comprises a lock shaft and a locking mechanism.

32. A combination lock as in claim 30, wherein each of said means for embodying a preset combination of said lock comprises a dial, rotatable by said user.

33. A combination lock as in claim 30, wherein said means for locking and unlocking said lock comprises a lever and a hasp.

34. A combination lock as in claim 30, wherein said means for embodying a preset combination comprise a drive cam and at least one wheel.

* * * * *